US009147392B2

(12) United States Patent
Hirose et al.

(10) Patent No.: US 9,147,392 B2
(45) Date of Patent: Sep. 29, 2015

(54) SPEECH SYNTHESIS DEVICE AND SPEECH SYNTHESIS METHOD

(71) Applicant: PANASONIC CORPORATION, Osaka (JP)

(72) Inventors: Yoshifumi Hirose, Kyoto (JP); Takahiro Kamai, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 129 days.

(21) Appl. No.: 13/903,270

(22) Filed: May 28, 2013

(65) Prior Publication Data

US 2013/0262120 A1 Oct. 3, 2013

Related U.S. Application Data

(63) Continuation of application No. PCT/JP2012/004529, filed on Jul. 12, 2012.

(30) Foreign Application Priority Data

Aug. 1, 2011 (JP) ..... 2011-168624

(51) Int. Cl.
*G10L 13/00* (2006.01)
*G10L 13/02* (2013.01)
(Continued)

(52) U.S. Cl.
CPC ..... *G10L 13/02* (2013.01); *G10L 13/06* (2013.01); *G10L 13/08* (2013.01); *G10L 2013/105* (2013.01)

(58) Field of Classification Search
CPC . G10L 2021/105; G10L 13/043; G10L 13/06; G10L 13/02; G10L 13/033; G10L 13/04; G10L 13/07; G10L 13/08; G10L 13/10; G10L 2013/105
USPC ..... 704/260, 258, 268
See application file for complete search history.

(56) References Cited

U.S. PATENT DOCUMENTS 6,751,592 B1 6/2004 Shiga
6,829,577 B1 * 12/2004 Gleason ..... 704/207
(Continued)

FOREIGN PATENT DOCUMENTS

EP 1617408 * 1/2006 ..... G10L 13/06
JP 10-247097 9/1998
(Continued)

OTHER PUBLICATIONS

M. Beutnagel et al., "Rapid Unit Selection from a Large Speech Corpus for Concatenative Speech Synthesis", Eurospeech, pp. 1-4, 1999.*
(Continued)

*Primary Examiner* — Abdelali Serrou
(74) *Attorney, Agent, or Firm* — Wenderoth, Lind & Ponack, L.L.P.

(57) ABSTRACT

A speech synthesis device includes: a mouth-opening-degree generation unit which generates, for each of phonemes generated from input text, a mouth-opening-degree corresponding to oral-cavity volume, using information generated from the text and indicating the type and position of the phoneme within the text, such that the generated mouth-opening-degree is larger for a phoneme at the beginning of a sentence in the text than for a phoneme at the end of the sentence; a segment selection unit which selects, for each of the generated phonemes, segment information corresponding to the phoneme from among pieces of segment information stored in a segment storage unit and including phoneme type, mouth-opening-degree, and speech segment data, based on the type of the phoneme and the generated mouth-opening-degree; and a synthesis unit which generates synthetic speech of the text, using the selected pieces of segment information and pieces of prosody information generated from the text.

17 Claims, 17 Drawing Sheets

(51) Int. Cl.

| | |
|---|---|
| ***G10L 13/06*** | (2013.01) |
| ***G10L 13/08*** | (2013.01) |
| *G10L 13/10* | (2013.01) |

(56) References Cited

U.S. PATENT DOCUMENTS

| | | | | |
|---|---|---|---|---|
| 7,209,882 | B1 * | 4/2007 | Cosatto et al. | 704/235 |
| 2002/0120436 | A1 * | 8/2002 | Mizutani et al. | 704/2 |
| 2004/0068406 | A1 * | 4/2004 | Maekawa et al. | 704/235 |
| 2004/0098256 | A1 * | 5/2004 | Nissen | 704/220 |
| 2006/0015344 | A1 * | 1/2006 | Kemmochi | 704/267 |
| 2007/0094029 | A1 * | 4/2007 | Saito et al. | 704/260 |
| 2007/0156408 | A1 * | 7/2007 | Saito et al. | 704/260 |
| 2009/0204395 | A1 * | 8/2009 | Kato et al. | 704/206 |
| 2009/0234652 | A1 * | 9/2009 | Kato et al. | 704/260 |
| 2009/0254349 | A1 * | 10/2009 | Hirose et al. | 704/260 |
| 2009/0281807 | A1 * | 11/2009 | Hirose et al. | 704/254 |
| 2010/0004934 | A1 * | 1/2010 | Hirose et al. | 704/261 |
| 2010/0204990 | A1 * | 8/2010 | Hirose et al. | 704/243 |
| 2010/0217584 | A1 * | 8/2010 | Hirose et al. | 704/206 |
| 2010/0250257 | A1 * | 9/2010 | Hirose et al. | 704/278 |
| 2011/0125493 | A1 * | 5/2011 | Hirose et al. | 704/207 |
| 2012/0095767 | A1 * | 4/2012 | Hirose et al. | 704/258 |

FOREIGN PATENT DOCUMENTS

| | | |
|---|---|---|
| JP | 2000-206982 | 7/2000 |
| JP | 3091426 | 9/2000 |
| JP | 2003-140678 | 5/2003 |
| JP | 2004-125843 | 4/2004 |
| JP | 2004-289614 | 10/2004 |
| JP | 2011-95397 | 5/2011 |

OTHER PUBLICATIONS

International Search Report issued Aug. 28, 2012 in corresponding International Application No. PCT/JP2012/004529.

Tatsuya Kitamura et al., "Individualities in vocal tract area functions during vowel production", transactions of Acoustical Society of Japan, Mar. 2004, pp. 285-286, with English translation.

Chang-Sheag Yang et al., "Non-uniformity of Formant Frequencies Effected by Difference of Vocal Tract Shapes", Transactions of the Acoustical Society of Japan, Mar. 1996, pp. 289-290, with partial English translation.

Takahiro Ohtsuka et al., "Robust ARX-based speech analysis method taking voicing source pulse train into account", in The Journal of the Acoustical Society of Japan, 58 (7), 2002, pp. 386-397, with partial English translation.

* cited by examiner

FIG. 10

| Explanatory variables | Category |
|---|---|
| Phoneme type | /a/, /i/, /u/, /e/, /o/, /k/, /d/, ••• |
| Number of mora counted from beginning of sentence | 1, 2, 3 ~ 10, 10 or more |
| Number of mora counted from end of sentence | 1, 2, 3 ~ 10, 10 or more |
| Position of target accent phrase from beginning of sentence | 1, 2, 3 ~ 10, 10 or more |
| Position of target accent phrase from end of sentence | 1, 2, 3 ~ 10, 10 or more |
| Accent type of target accent phrase | Beginning of sentence, Flat, Type 1, Type 2, Type 3, Type 4 |
| Distance from an accent position | -5, -4, -3, -2, -1, 0, 1, 2, 3, 4, 5 |
| Part of speech of target morpheme | Noun, Verb, Adjective ••• |
| Fundamental frequency of target phoneme | <100, <200, <300, <400 [Hz] |
| Duration of target phoneme | <10, <50, <100, <200 [msec] |

| Phoneme number | Phoneme type | PARCOR coefficient | | | Mouth opening degree | Phoneme environment | | Voicing source information | | Prosody information | | Duration (msec) |
|---|---|---|---|---|---|---|---|---|---|---|---|---|
| | | k1 | ··· | k10 | | Preceding | Following | Glottal OQ | Spectral tilt (dB/oct.) | F0 (Hz) | Power | |
| 1 | /a/ | 0.589 | ··· | 0.212 | 10 | k | r | 0.5 | -2 | 170 | 100 | 50 |
| 2 | /a/ | 0.652 | ··· | 0.153 | 12 | t | g | 0.4 | -3 | 150 | 120 | 100 |
| ⋮ | ⋮ | ⋮ | ⋮ | ⋮ | ⋮ | ⋮ | ⋮ | ⋮ | ⋮ | ⋮ | ⋮ | ⋮ |

SPEECH SYNTHESIS DEVICE AND SPEECH SYNTHESIS METHOD

CROSS REFERENCE TO RELATED APPLICATIONS

This is a continuation application of PCT International Application No. PCT/JP2012/004529 filed on Jul. 12, 2012, designating the United States of America, which is based on and claims priority of Japanese Patent Application No. 2011-168624 filed on Aug. 1, 2011. The entire disclosures of the above-identified applications, including the specifications, drawings and claims are incorporated herein by reference in their entirety.

FIELD

One or more exemplary embodiments disclosed herein relate to a speech synthesis device and a speech synthesis method which are capable of generating natural-sounding synthetic speech.

BACKGROUND

In recent years, creation of synthetic speech with significantly high sound quality has become possible with the development of speech synthesis technologies. As a speech synthesis device which provides high real-voice feel, there is a speech synthesis device which uses a waveform concatenation method of selecting speech waveforms from a large segment storage unit and concatenating the speech waveforms (for example, see Patent Literature (PTL) 1). FIG. 17 is a diagram showing a typical configuration of a waveform concatenation speech synthesis device.

The speech synthesis device shown in FIG. 17 includes a language analysis unit 501, a prosody generation unit 502, a speech segment database (DB) 503, a segment selection unit 504, and a waveform concatenation unit 505.

The language analysis unit 501 linguistically analyzes text that has been input, and outputs pronunciation symbols and accent information. The prosody generation unit 502 generates, for each of the phonetic symbols, prosody information such as a fundamental frequency, a duration, and power, based on the pronunciation symbols and accent information output by the language analysis unit 501. The speech segment DB 503 is a segment storage unit for storing speech waveforms as pre-recorded pieces of speech segment data (hereafter referred to simply as "speech segments"). The segment selection unit 504 selects optimum speech segments from the speech segment DB 503, based on the prosody information generated by the prosody generation unit 502. The waveform concatenation unit 505 generates synthetic speech by concatenating the speech segments selected by the segment selection unit 504.

CITATION LIST

Patent Literature

[PTL 1] Unexamined Japanese Patent Application Publication No. H10-247097

[PTL 2] Unexamined Japanese Patent Application Publication No. 2004-125843

Non Patent Literature

[NPL 1] "Individualities in Vocal Tract Functions During Vowel Production" by Tatsuya Kitamura, et. al., in The Acoustical Society of Japan, 2004 Spring Research Presentation Conference Lecture Papers I, The Acoustical Society of Japan, March 2004

[NPL 2] "Non-uniformity of Formant Frequencies Effected by Difference of Vocal Tract Shapes" by Yang Chang-Sheng, et. al., in The Acoustical Society of Japan Research Presentation Conference Lecture Papers, Spring I, 1996

SUMMARY

Technical Problem

The speech synthesis device in PTL 1 selects speech segments stored in the segment storage unit, based on the phoneme environment and prosody information for input text, and synthesizes speech by concatenating the selected speech segments.

However, it is difficult to determine the voice quality that synthetic speech must possess from only the aforementioned phoneme environment and prosody information.

The inventors have found that, when the temporal variation in utterance manner is different from the temporal variation in the input speech, the naturalness of variations in the utterance manner of the synthetic speech cannot be maintained. As a consequence, the naturalness of the synthetic speech significantly deteriorates.

One non-limiting and exemplary embodiment provides a speech synthesis device that reduces deterioration of naturalness during speech generation by synthesizing speech while maintaining the temporal variation in utterance manner possessed by speech in the case where the input text is uttered naturally.

Solution to Problem

In one general aspect, the techniques disclosed here feature a speech synthesis device that generates synthetic speech of text that has been input, the speech synthesis device including: a mouth opening degree generation unit configured to generate, for each of phonemes generated from the text, a mouth opening degree corresponding to an oral cavity volume, using information generated from the text and indicating a type of the phoneme and a position of the phoneme within the text, the mouth opening degree to be generated being larger for a phoneme positioned at a beginning of a sentence in the text than for a phoneme positioned at an end of the sentence; a segment selection unit configured to select, for each of the phonemes generated from the text, a piece of segment information corresponding to the phoneme from among pieces of segment information stored in a segment storage unit, based on the type of the phoneme and the mouth opening degree generated by the mouth opening degree generation unit, each of the pieces of segment information including a phoneme type, information on a mouth opening degree, and speech segment data; and a synthesis unit configured to generate the synthetic speech of the text, using the pieces of segment information selected by the segment selection unit and pieces of prosody information generated from the text.

It should be noted that these general and specific aspects may be implemented using a system, a method, an integrated circuit, a computer program, or a computer-readable recording medium such as a CD-ROM, or any combination of systems, methods, integrated circuits, computer programs, or computer-readable recording media.

Additional benefits and advantages of the disclosed embodiments will be apparent from the Specification and Drawings. The benefits and/or advantages may be individually obtained by the various embodiments and features of the Specification and Drawings, which need not all be provided in order to obtain one or more of such benefits and/or advantages.

Advantageous Effects

The speech synthesis device according to one or more exemplary embodiments or features disclosed herein is capable of synthesizing speech in which deterioration of naturalness during speech synthesis is reduced, by synthesizing speech while maintaining the temporal variation in utterance manner possessed by speech in the case where input text is uttered naturally.

BRIEF DESCRIPTION OF DRAWINGS

These and other advantages and features will become apparent from the following description thereof taken in conjunction with the accompanying Drawings, by way of non-limiting examples of embodiments disclosed herein.

FIG. 10 is a table showing an example of control factors used as explanatory variables and categories thereof.

DESCRIPTION OF EMBODIMENT (Underlying Knowledge Forming Basis of the Present Disclosure)

The voice quality of natural speech is influenced by various factors including a speaking rate, a position in the uttered speech, and a position in an accented phrase. For example, in natural speech utterance, the beginning of a sentence is uttered distinctly and with high clarity, but clarity tends to deteriorate at the end of the sentence due to lazy pronunciation. In addition, in speech utterance, when a certain word is emphasized, the voice quality of that word tends to have high clarity compared to when the word is not emphasized.

Figure 1:
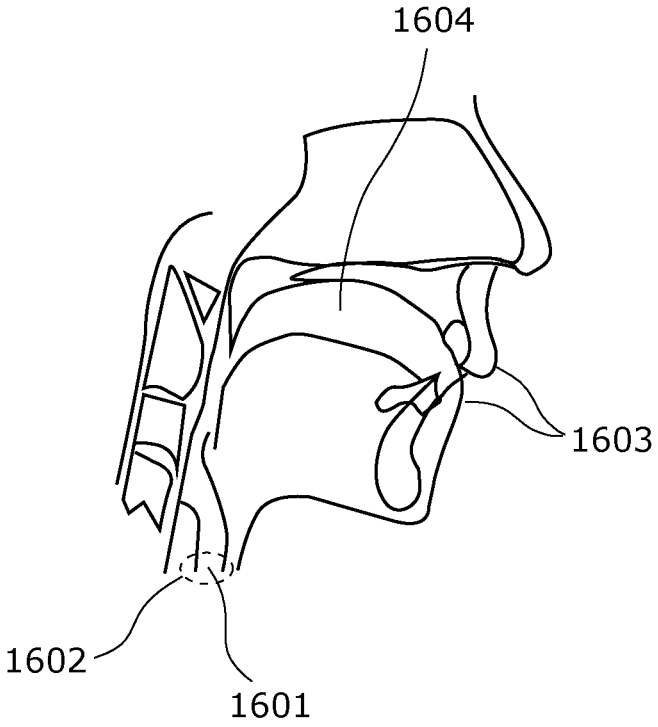
FIG. 1 is a diagram showing a human vocal tract system.

FIG. 1 shows human vocal cords and vocal tract. The principle of human speech generation shall be described below. The process of human speech generation shall be described. A source waveform generated from vibration of vocal cords 1601 shown in FIG. 1 passes through a vocal tract 1604 from a glottis 1602 to lips 1603. A voiced sound of speech is produced by way of the source waveform being affected by influences such as the narrowing of the vocal tract 1604 by an articulatory organ like the tongue, when the source waveform passes the vocal tract 1604. In a speech synthesis method based on analysis and synthesis, human speech is analyzed according to the aforementioned principle of speech generation. Specifically, vocal tract information and voicing source information are obtained by separating speech into vocal tract information and voicing source information. Examples of the method for analyzing the speech includes a method using a model called a "vocal-tract/voicing-source model". In the analysis using the vocal-tract/voicing-source model, a speech is separated into voicing source information and vocal tract information on the basis of the generation process of this speech.

Figure 2:
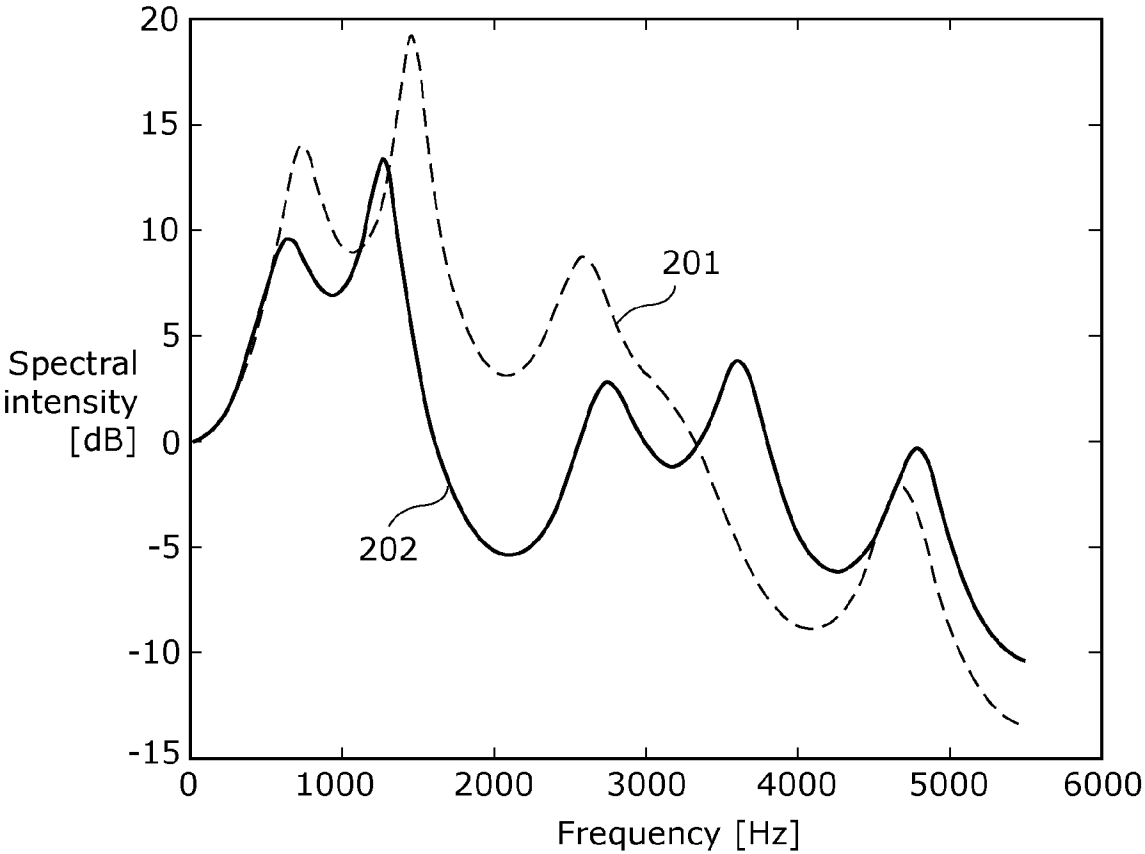
FIG. 2 is a graph showing difference in vocal-tract transfer characteristics caused by differences in utterance manners.

FIG. 2 shows vocal-tract transfer characteristics identified using the aforementioned vocal-tract/voicing-source model. In FIG. 2, the horizontal axis represents the frequency and the vertical axis represents the spectral intensity. FIG. 2 shows vocal-tract transfer characteristics resulting from analysis of phonemes with the same phoneme immediately preceding it in respective speeches uttered by the same speaker. The phoneme immediately preceding the target phoneme shall be called a preceding phoneme.

A curve 201 shown in FIG. 2 indicates the vocal-tract transfer characteristic of /a/ of /ma/ in "memai" when "/memaigasimasxu/" is uttered. A curve 202 indicates the vocal-tract transfer characteristic of /a/ of /ma/ when "/oyugademaseN/" is uttered. In FIG. 2, an upward peak indicates a formant of a resonance frequency. As shown in FIG. 2, it can be understood that, even when comparing vowels having preceding phonemes whose formant positions (frequencies) and spectral intensities are the same, the vocal-tract transfer characteristics of these vowels are significantly different.

The vowel /a/ having the vocal-tract transfer characteristic indicated by the curve 201 is dose to the beginning of the sentence and is a phoneme included in a content word. On the other hand, the vowel /a/ having the vocal-tract transfer characteristic indicated by the curve 202 is dose to the end of the sentence and is a phoneme included in a function word. Here, a function word refers to a word playing a grammatical role. In the English language, examples of a function word include prepositions, conjunctions, articles, and auxiliary verbs. Furthermore, a content word refers to a word which is not a function word and has a general meaning, in the English language, examples of the content word include nouns, adjectives, verbs, and adverbs. Moreover, in the auditory sense, the vowel /a/ having the vocal-tract transfer characteristic indicated by the curve 201 sounds more clearly. In this manner, in the natural utterance of a speech, the manner in which a phoneme is uttered is different depending on the position of the phoneme in the sentence. A person intentionally or unintentionally changes the manner of utterance, such as in "a speech uttered distinctly and clearly" or "a speech uttered lazily and unclearly". In this Specification, such manners of utterance between which such a difference is found are referred to as the "utterance manners". The utterance manner varies according to not only the position of a phoneme in a sentence, but also other various linguistic and physiological factors. The position of a phoneme in a sentence is referred to as "phoneme environment". As described above, even when the phoneme environment is the same, the vocal-tract transfer characteristic is different when the utterance manner is different. In other words, the speech segment that should be selected is different.

The speech synthesis device in PTL 1 selects speech segments using the phoneme environment and prosody information without considering the aforementioned variations in utterance manner, and performs speech synthesis using the selected speech segments. The utterance manner of the synthetic speech is different from the utterance manner of naturally uttered speech. As a result, the temporal variations in the utterance manner of synthetic speech are different from the temporal variations in natural speech. Therefore, the synthetic speech becomes an extremely unnatural speech compared to a normal human utterance.

Figure 3:
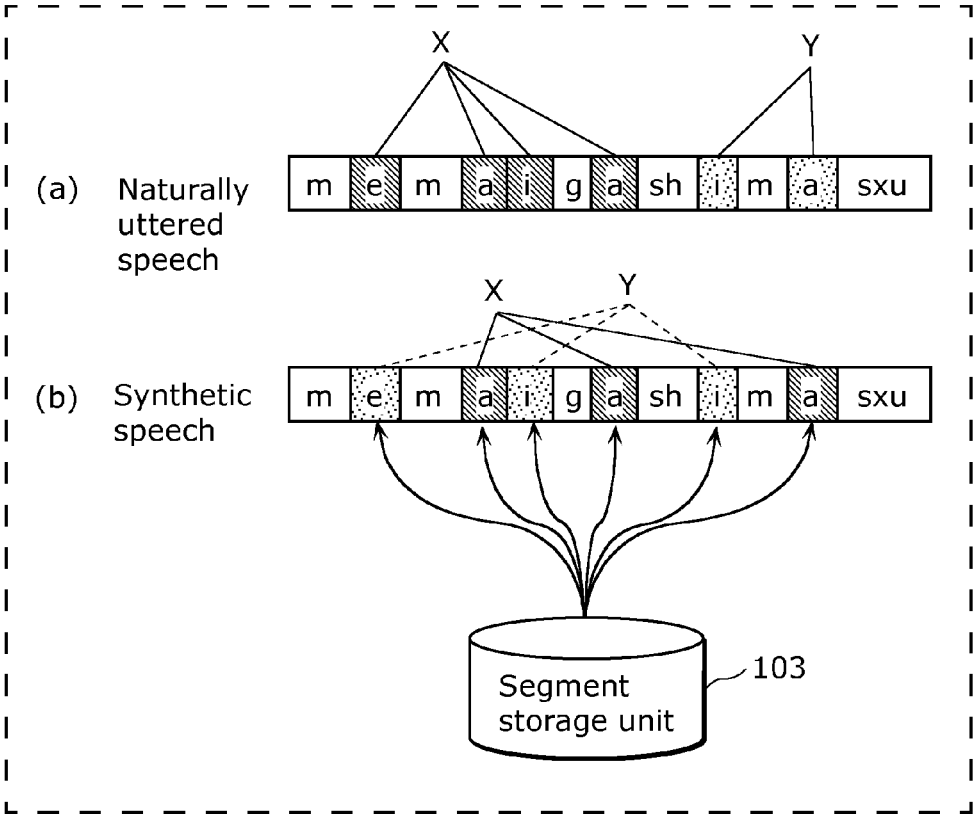
FIG. 3 is conceptual diagram showing temporal change in utterance manners.

FIG. 3 shows temporal variations of utterance manners. In FIG. 3, (a) shows the temporal variation in utterance manner when "/memaigasimasxu/" is uttered naturally. In a naturally uttered speech, the beginning of a sentence tends to be uttered distinctly and with high clarity, and there is a tendency for lazy utterance as the end of the sentence approaches. In FIG. 3, phonemes indicated by X are uttered distinctly and have high clarity. Phonemes indicated by Y are uttered lazily and have low clarity. Thus, in the example in (a), the first half of the sentence has an utterance manner with high clarity because there are many phonemes indicated by X. The second half of the sentence has an utterance manner with low clarity because there are many phonemes indicated by Y.

On the other hand, (b) in FIG. 3 shows the temporal variation in utterance manner of synthetic speech when speech segments are selected according to the conventional selection criterion. With the conventional criterion, speech segments are selected based on the phoneme environment or prosody information. As such, the utterance manner varies without being restricted by the input selection criterion.

For example, it is possible for the distinctly and clearly uttered phonemes indicated by X and the lazily uttered phonemes indicated by Y to appear alternately as shown in (b) in FIG. 3.

In this manner, there is significant deterioration in the naturalness of synthetic speech having such a temporal variation in utterance manner which cannot occur in natural speech.

Figure 4:
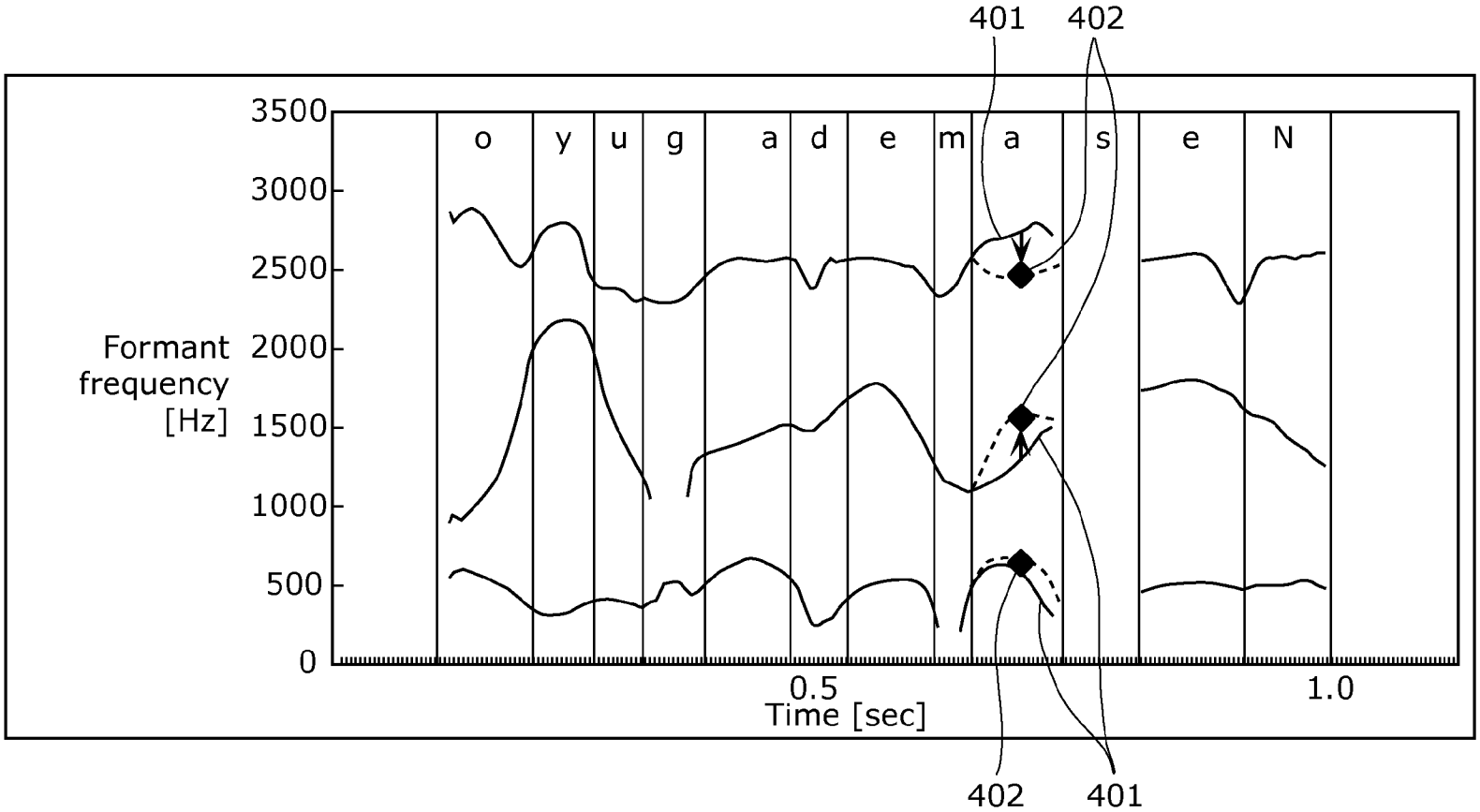
FIG. 4 is a graph showing an example of differences in formant frequencies caused by differences in utterance manners.

FIG. 4 shows an example of transition of a formant 401 in the case where speech is synthesized, for the uttered speech "/oyugademaseN/", using the /a/ uttered distinctly and with high clarity.

In FIG. 4, the horizontal axis represents the time and the vertical axis represents the formant frequency. First, second, and third formants are shown in order of increasing frequency. It can be seen that, as for /ma/, a formant 402 obtained by synthesizing speech using /a/ having a different utterance manner (distinctly and with high clarity) is significantly different in frequency from the formant 401 of the original utterance (distinctly and with high clarity) in this manner, when a speech segment is significantly different in formant frequency from the speech segment of the original utterance, the temporal transition of each formant is large as shown by dashed lines in FIG. 4. Consequently, voice quality is not only different, the synthetic speech is also locally-unnatural.

A speech synthesis according to an exemplary embodiment disclosed herein is a speech synthesis device that generates synthetic speech of text that has been input, the speech synthesis device including: a prosody generation unit configured to generate, for each of phonemes generated from the text, a piece of prosody information by using the text; a mouth opening degree generation unit configured to generate, for each of the phonemes generated from the text, a mouth opening degree corresponding to an oral cavity volume, using information generated from the text and indicating a type of the phoneme and a position of the phoneme within the text, the mouth opening degree to be generated being larger for a phoneme positioned at a beginning of a sentence in the text than for a phoneme positioned at an end of the sentence; a segment storage unit in which pieces of segment information are stored, each of the pieces of segment information including a phoneme type, information on a mouth opening degree, and speech segment data; a segment selection unit configured to select, for each of the phonemes generated from the text, a piece of segment information corresponding to the phoneme from among the pieces of segment information stored in the segment storage unit, based on the type of the phoneme and the mouth opening degree generated by the mouth opening degree generation unit; and a synthesis unit configured to generate the synthetic speech of the text, using the pieces of segment information selected by the segment selection unit and the pieces of prosody information generated by the prosody generation unit.

According to this configuration, segment information having a mouth opening degree that agrees with the input text-based mouth opening degree is selected. As such, it is possible to select segment information (a speech segment) having the same utterance manner as the input text-based utterance manner (distinct and high-clarity speech or lazy and low-clarity speech). Therefore, it is possible to synthesize speech while maintaining the input text-based temporal variation in utterance manner. Consequently, since the input text-based temporal pattern of the variation in utterance manner is maintained in the synthetic speech, deterioration of naturalness (fluency) during speech synthesis is reduced.

Furthermore, the speech synthesis device may further include an agreement degree calculation unit configured to, for each of the phonemes generated from the text, select a piece of segment information having a phoneme type that matches the type of the phoneme from among the pieces of segment information stored in the segment storage unit, and calculate a degree of agreement between the mouth opening degree generated by the mouth opening degree generation unit and the mouth opening degree included in the selected piece of segment information, wherein the segment selection unit may be configured to select, for each of the phonemes generated from the text, the piece of segment information corresponding to the phoneme, based on the degree of agreement calculated for the phoneme.

According to this configuration, segment information can be selected based on the degree of agreement between the input text-based mouth opening degree and the mouth opening degree included in the segment information. As such, even when segment information having a mouth opening degree that is the same as the input text-based mouth opening degree is not stored in the segment storage unit, segment information having a mouth opening degree that is similar to the input text-based mouth opening can be selected.

For example, the segment selection unit is configured to select, for each of the phonemes generated from the text, the piece of segment information including the mouth opening degree indicated by the degree of agreement calculated for the phoneme as having highest agreement.

According to this configuration, even when segment information having a mouth opening degree that is the same as the input text-based mouth opening degree is not stored in the segment storage unit, segment information having a mouth opening degree that is most similar to the input text-based mouth opening can be selected.

Furthermore, each of the pieces of segment information stored in the segment storage unit may further include prosody information and phoneme environment information indicating a type of a preceding phoneme or a following phoneme that precedes or follows the phoneme, and the segment selection unit may be configured to select, for each of the phonemes generated from the text, the piece of segment information corresponding to the phoneme from among the pieces of segment information stored in the segment storage unit, based on the type, the mouth opening degree, and phoneme environment information of the phoneme, and the piece of prosody information generated by the prosody generation unit.

According to this configuration, segment information is selected with consideration being given to both the agreement of phoneme environment information and prosody information as well as the agreement of mouth opening degrees, and thus it is possible to take into consideration the mouth opening degree after considering the phoneme environment and prosody information. As such, compared to selecting segment information using only the phoneme environment and the prosody information, the temporal variation of a natural utterance manner can be reproduced and, therefore, synthetic speech with a high degree of naturalness can be obtained.

Furthermore, the speech synthesis device may further include a target cost calculation unit configured to, for each of the phonemes generated from the text, select the piece of segment information having the phoneme type that matches the type of the phoneme from among the pieces of segment information stored in the segment storage unit, and calculate a cost indicating agreement between the phoneme environment information of the phoneme and the phoneme environment information included in the selected piece of segment information, wherein the segment selection unit may be configured to select, for each of the phonemes generated from the text, the piece of segment information corresponding to the phoneme, based on the degree of agreement and the cost that were calculated for the phoneme.

Furthermore, the segment selection unit may be configured to, for each of the phonemes generated from the text, assign a weight to the cost calculated for the phoneme, and select the piece of segment information corresponding to the phoneme, based on the weighted cost and the degree of agreement calculated by the agreement degree calculation unit, the assigned weight being larger as the pieces of segment information stored in the segment storage unit are larger in number.

According to this configuration, during the selection of segment information, the weight assigned to the mouth opening degree calculated by the mouth opening degree calculation unit is decreased as the pieces of segment information stored in the segment storage unit are larger in number. In other words, the weights assigned to the costs for the phoneme environment information and the prosody information which are calculated by the target cost calculation unit are increased. Accordingly, even when there is no segment information having highly similar phoneme environment information and prosody information in the case where the pieces of segment information stored in the segment storage unit are small in number, a piece of segment information having a matching utterance manner is selected by selecting a piece of segment information having a mouth opening degree with a high degree of agreement. With this, a temporal variation of utterance manner that is natural overall can be reproduced and, therefore, synthetic speech with a high degree of naturalness can be obtained.

Furthermore, the agreement degree calculation unit may be configured to, for each of the phonemes generated from the text, normalize, on a phoneme type basis, (i) the mouth opening degree included in the piece of segment information stored in the segment storage unit and having the phoneme type that matches the type of the phoneme and (ii) the mouth opening degree generated by the mouth opening degree generation unit, and calculate, as the degree of agreement, a degree of agreement between the normalized mouth opening degrees.

According to this configuration, the degree of agreement of the mouth opening degree is calculated using mouth opening degrees that have been normalized per phoneme type. As such, the degree of agreement can be calculated after distinguishing the phoneme type. Accordingly, since an appropriate piece of segment information can be selected for each phoneme, the temporal variation pattern of natural utterance manner can be reproduced, and thus synthetic speech with a high degree of naturalness can be obtained.

Furthermore, the agreement degree calculation unit may be configured to, for each of the phonemes generated from the text, calculate, as the degree of agreement, a degree of agreement between a time direction difference of the mouth opening degree generated by the mouth opening degree generation unit and a time direction difference of the mouth opening degree included in the piece of segment information stored in the segment storage unit and having the phoneme type that matches the type of the phoneme.

According to this configuration, the degree of agreement of the mouth opening degree can be calculated based on the temporal variations in mouth opening degree. Accordingly, since the segment information can be selected taking the mouth opening degree of the preceding phoneme into consideration, the temporal variation of a natural utterance manner can be reproduced and, therefore, synthetic speech with a high degree of naturalness can be obtained.

Furthermore, the speech synthesis device may further include: a mouth opening degree calculation unit configured to calculate, from a speech of a speaker, a mouth opening degree corresponding to an oral cavity volume of the speaker; and a segment registration unit configured to register, in the segment storage unit, segment information including the phoneme type, information on the mouth opening degree calculated by the mouth opening degree calculation unit, and the speech segment data.

According to this configuration, it is possible to create the segment information to be used in speech synthesis. As such, the segment information to be used in speech synthesis can be updated whenever necessary.

Furthermore, the speech synthesis device may further include a vocal tract information extraction unit configured to extract vocal tract information from the speech of the speaker, wherein the mouth opening degree calculation unit may be configured to calculate a vocal tract cross-sectional area function indicating vocal tract cross-sectional areas, from the vocal tract information extracted by the vocal tract information extraction unit, and calculate, as the mouth opening degree, a sum of the vocal tract cross-sectional areas indicated by the calculated vocal tract cross-sectional area function.

According to this configuration, by calculating the mouth opening degree using the vocal tract cross-sectional area function, it is possible to calculate a mouth opening degree which takes into consideration, not only the degree to which the lips are open but also to the shape of the oral cavity (a position of the tongue, for example) which cannot be observed directly from the outside.

Furthermore, the mouth opening degree calculation unit may be configured to calculate the vocal tract cross-sectional area function indicating the vocal tract cross-sectional areas on a per section basis, and calculate, as the mouth opening degree, a sum of the vocal tract cross-sectional areas indicated by the calculated vocal tract cross-sectional area function, from a section corresponding to lips up to a predetermined section.

According to this configuration, it is possible to calculate a mouth opening degree which takes into consideration the shape of the oral cavity near the lips.

Furthermore, the mouth opening degree generation unit may be configured to generate the mouth opening degree, using information generated from the text and indicating the type of the phoneme and a position of the phoneme within an accent phrase.

In this manner, by generating the mouth opening degree using the position of the accent phrase of the phoneme, it is possible to generate a mouth opening degree which further considers linguistic influences.

Furthermore, the position of the phoneme within the accent phrase may denote a distance from an accent position within the accent phrase.

In the accent position, there is a tendency for emphasis in the utterance, and thus there is a tendency for the mouth opening degree to increase. According to this configuration, it is possible to generate a mouth opening degree which takes into consideration such an influence.

Furthermore, the mouth opening generation unit may be further configured to generate the mouth opening degree using information generated from the text and indicating a part of speech of a morpheme to which the phoneme belongs.

A morpheme that can be a content word, such as a noun, verb, or the like, is likely to be emphasized. When emphasized, the mouth opening degree tends to increase. According to this configuration, it is possible to generate a mouth opening degree which takes into consideration such an influence.

Furthermore, a speech synthesis device according to another exemplary embodiment disclosed herein is a speech synthesis device that generates synthetic speech of text that has been input, the speech synthesis device including: a mouth opening degree generation unit configured to generate, for each of phonemes generated from the text, a mouth opening degree corresponding to an oral cavity volume, using information generated from the text and indicating a type of the phoneme and a position of the phoneme within the text, the mouth opening degree to be generated being larger for a phoneme positioned at a beginning of a sentence in the text than for a phoneme positioned at an end of the sentence; a segment selection unit configured to select, for each of the phonemes generated from the text, a piece of segment information corresponding to the phoneme from among pieces of segment information stored in a segment storage unit, based on the type of the phoneme and the mouth opening degree generated by the mouth opening degree generation unit, each of the pieces of segment information including a phoneme type, information on a mouth opening degree, and speech segment data; and a synthesis unit configured to generate the synthetic speech of the text, using the pieces of segment information selected by the segment selection unit and pieces of prosody information generated from the text.

According to this configuration, segment information having a mouth opening degree that agrees with the input text-based mouth opening degree is selected. As such, it is possible to select segment information (a speech segment) having the same utterance manner as the input text-based utterance manner (distinct and high-clarity speech or lazy and low-clarity speech). Therefore, it is possible to synthesize speech while maintaining the input text-based temporal variation in utterance manner. Consequently, since the input text-based temporal pattern of the variation in utterance manner is maintained in the synthetic speech, deterioration of naturalness (fluency) during speech synthesis is reduced.

It should be noted that these general and specific aspects may be implemented using a system, a method, an integrated circuit, a computer program, or a computer-readable recording medium such as a CD-ROM, or any combination of systems, methods, integrated circuits, computer programs, or computer-readable recording media.

Hereinafter, certain exemplary embodiments shall be described with reference to the Drawings. It should be noted that each of the embodiments described hereafter illustrates a specific example. The numerical values, structural elements, the arrangement and connection of the structural elements, steps, the processing order of the steps etc. shown in the following exemplary embodiment and modifications thereof are mere examples, and therefore do not limit the scope of the appended Claims and their equivalents. Furthermore, among the structural elements in the following embodiment and modifications thereof, structural elements not recited in any one of the independent claims are described as arbitrary elements.

Embodiment 1

As described earlier, in synthesizing speech from text, it is important to maintain the temporal variations in utterance manner of when input text is uttered naturally. Utterance manners refer to, for example, distinct and clear utterance and lazy and unclear utterance.

The utterance manner is influenced by various factors such as a speaking rate, a position in the uttered speech, or a position in an accented phrase. For example, when a speech is uttered naturally, the beginning of a sentence is uttered distinctly and quite clearly. However, clarity tends to decrease at the end of the sentence due to lazy utterance. Furthermore, in the input text, the utterance manner when a word is emphasized is different from the utterance manner when the word is not emphasized.

However, in the case where speech segments are selected based on the phoneme environment or prosody information assumed from the input text as in the conventional technique, there is no guarantee that the temporal pattern of natural utterance manner will be maintained. In order to guarantee this, it is necessary to construct a segment storage unit that stores a large number of speech segments as more utterances that are the same as the input text are included in the segment storage unit, but actually constructing such a segment storage unit is impossible.

For example, in the case of a system for segment concatenative speech synthesis by rule, it is not uncommon to prepare several hours to several tens of hours of speech for constructing a segment database, Nevertheless, realizing the temporal patterns of natural speech manners for all input text is difficult.

According to this embodiment, it is possible to perform speech synthesis taking into consideration the aforementioned temporal pattern of natural utterance manner, even when the amount of data in the segment storage unit is relatively small.

Figure 5:
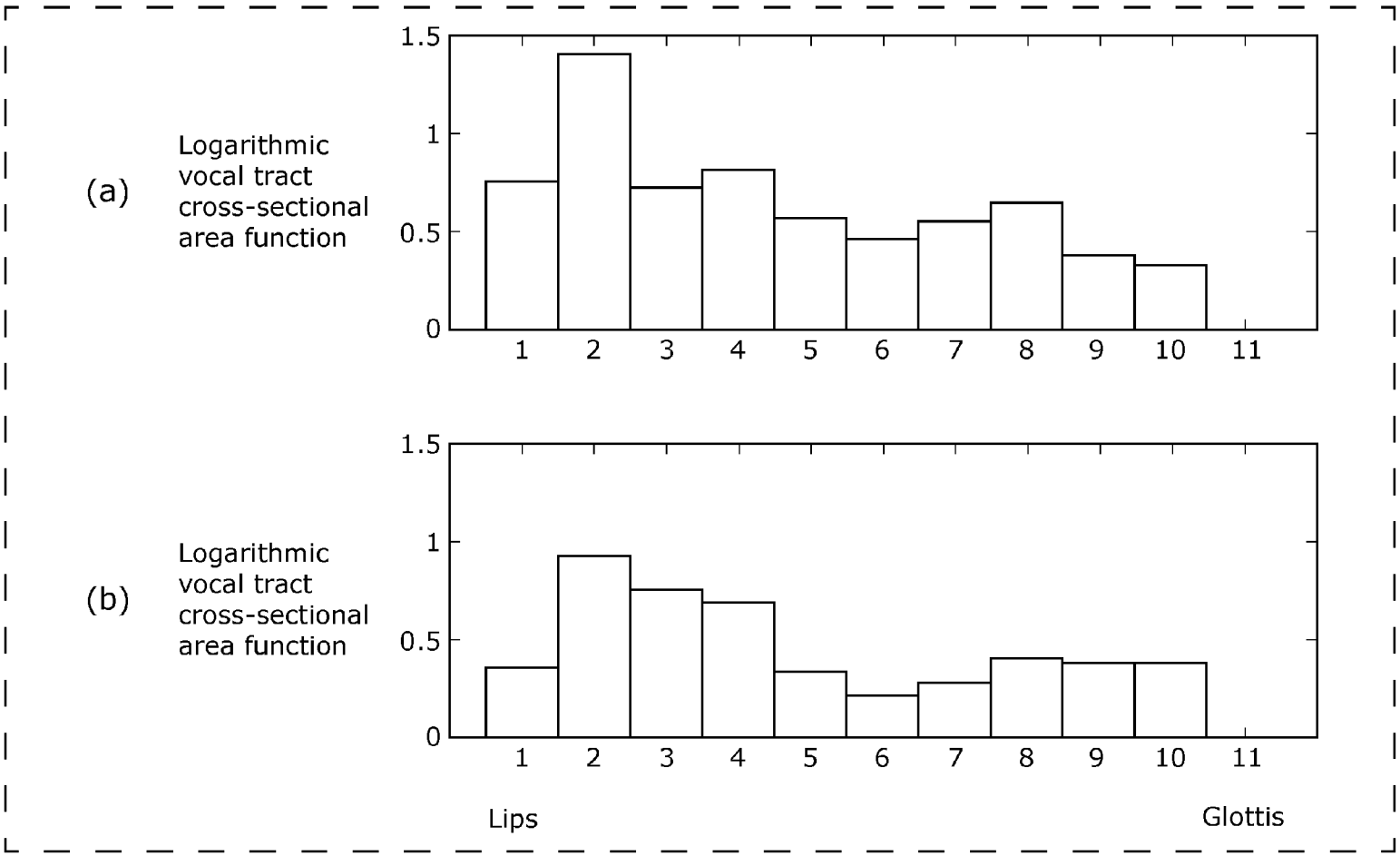
FIG. 5 shows differences in vocal tract cross-sectional functions caused by differences in utterance manners.

In FIG. 5, (a) shows a logarithmic vocal tract cross-sectional area function of /a/ of /ma/ included in "memai" when "/memaigasimasxu/" described earlier is uttered. In FIG. 5, (b) shows a logarithmic vocal tract cross-sectional area function of /a/ of /ma/ when "/oyugademaseN/" is uttered.

In (a) of FIG. 5, since the vowel /a/ is close to the beginning of the sentence and is a sound included in a content word (i.e., an independent word), the utterance manner for this vowel is distinct and clear. On the other hand, in (b) of FIG. 5, since the vowel /a/ is close to the end of the sentence, the utterance manner for this vowel is lazy and with low clarity.

The inventors carefully observed a relation between such a difference in the utterance manners and the logarithmic vocal tract cross-sectional area functions and found a link between the utterance manner and a volume of the oral cavity.

More specifically, when the volume of the oral cavity is larger, the utterance manner tends to be distinct and clear. In contrast, when the volume of the oral cavity is smaller, the utterance manner tends to be lazy and the clarity tends to be low.

By using the oral cavity volume that can be calculated from the speech as an index of the degree to which the mouth is opened (hereafter referred to as the "mouth opening degree"), a speech segment having a desired utterance manner can be found from the segment storage unit. When the utterance manner is indicated by one value such as the oral cavity volume, consideration does not need to be given to the information on various combinations of a position in an uttered speech, a position in an accented phrase, or the presence or absence of an emphasized word. This allows the speech segment having the desired characteristic to be found easily from the segment storage unit. Moreover, the necessary amount of speech segments can be reduced by reducing the number of types of phonetic environments. This reduction in number can be achieved by forming phonemes having similar characteristics into one category instead of sorting the phoneme environment for each phoneme.

The present disclosure maintains the temporal variation of the utterance manner of when the input text is uttered naturally by using the oral cavity volume, and thereby realizes speech synthesis with little loss of naturalness in the resultant speech. In other words, synthetic speech which maintains the temporal variation of the utterance manner of when the input text is uttered naturally is generated by making the mouth opening degree at the beginning of a sentence bigger than the mouth opening degree at the end of the sentence. With this, it is possible to generate synthetic speech having a natural utterance manner in which the beginning of the sentence is uttered distinctly and clearly, and the end of the sentence has low clarity due to laziness.

Figure 6:
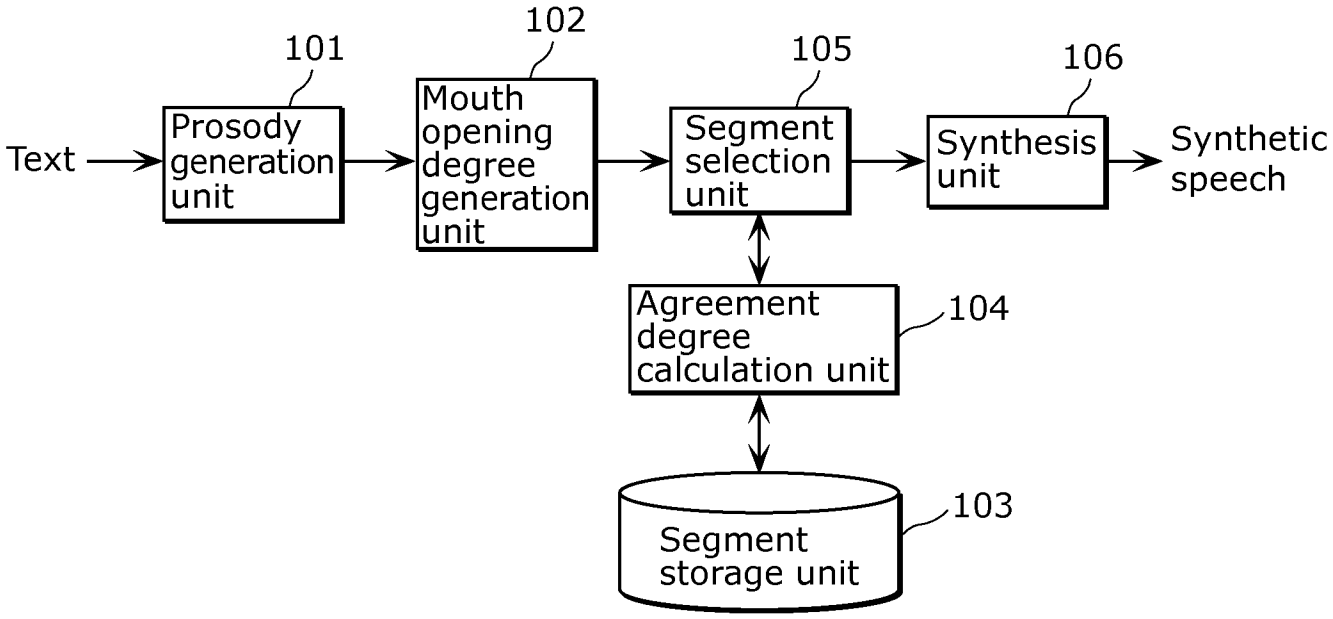
FIG. 6 is a configuration diagram of the speech synthesis device according to Embodiment 1.

FIG. 6 is a block diagram showing a functional configuration of the speech synthesis device according to Embodiment 1. The speech synthesis device includes a prosody generation unit 101, a mouth opening degree generation unit 102, a segment storage unit 103, an agreement degree calculation unit 104, a segment selection unit 105, and a synthesis unit 106.

The prosody generation unit 101 generates prosody information by using input text. Specifically, the prosody generation unit 101 generates phoneme information and prosody information that corresponds to a phoneme.

The mouth opening degree generation unit 102 generates, based on the input text, a temporal pattern of the mouth opening degree of when the input text is uttered naturally. Specifically, the mouth opening degree generation unit 102 generates, for each of the phonemes generated from the input text, a mouth opening degree corresponding to the volume of the oral cavity, by using information generated from the input text and indicating the type of the target phoneme and the position of the target phoneme within the text.

The segment storage unit 103 is a storage unit for storing segment information for generating synthetic speech, and is configured by, for example, a hard disk drive (HDD). Specifically, the segment storage unit 103 stores plural pieces of segment information each including a phoneme type, mouth opening degree information, and vocal tract information. Here, vocal tract information is one type of speech segment, Details of the segment information stored in the segment storage unit 103 shall be discussed later.

The agreement degree calculation unit 104 calculates a degree of agreement (hereafter also referred to as "agreement degree") between the mouth opening degree generated on a phoneme basis by the mouth opening degree generation unit 102 and the mouth opening degree of each phoneme segment stored in the segment storage unit 103. Specifically, the agreement degree calculation unit 104 selects, for each of the phonemes generated from the text, a piece of segment information having a phoneme type that matches the type of a the target phoneme, from among the pieces of segment information stored in the segment storage unit 103, and calculates the agreement degree between the mouth opening degree generated by the mouth opening degree generation unit 102 and the mouth opening degree included in the selected piece of segment information.

The segment selection unit 105 selects, based on the agreement degree calculated by the agreement degree calculation unit 104, an optimal piece of segment information from among the pieces of segment information stored in the segment storage unit 103, and selects a speech segment sequence by concatenating the speech segments included in the selected pieces of segment information. It should be noted that, in the case where pieces of segment information for all mouth opening degrees are stored in the segment selection unit 105, the segment selection unit 105 need only select, from among the segment information stored in the segment storage unit 103, a piece of segment information including a mouth opening degree that matches the mouth opening degree generated by the mouth opening degree generation unit 102. Accordingly, in such a case, the agreement degree calculation unit 104 need not be provided in the speech synthesis device.

The synthesis unit 106 generates synthetic speech by using the speech segment sequence selected by the segment selection unit 504.

The speech synthesis device configured in the above-described manner is capable of generating synthetic speech having the temporal variations of the utterance manner of when the input text is uttered naturally.

Hereinafter, the respective structural elements shall be described in detail.

[Prosody Generation Unit 101]

The prosody generation unit 101 generates, based on input text, prosody information of when the input text is uttered. The input text is made up of plural characters. When text including plural sentences is input, the prosody generation unit 101 divides the text into individual sentences based on information such as periods and so on, and generates prosody on a per sentence basis, it should be noted that, even for text written in English and so on, the prosody generation unit 101 also generates prosody by performing the process of dividing the text into individual sentences.

Furthermore, the prosody generation unit 101 linguistically analyzes a sentence, and obtains language information such as a phonetic symbol sequence and accents. The language information includes the number of mora counted from the beginning of the sentence, the number of mora counted from the end of the sentence, a position of a target accent phrase from the beginning of the sentence, a position of the target accent phrase from the end of the sentence, the accent type of the target accent phrase, distance from an accent position, and the part-of-speech of a target morpheme.

Figure 7:
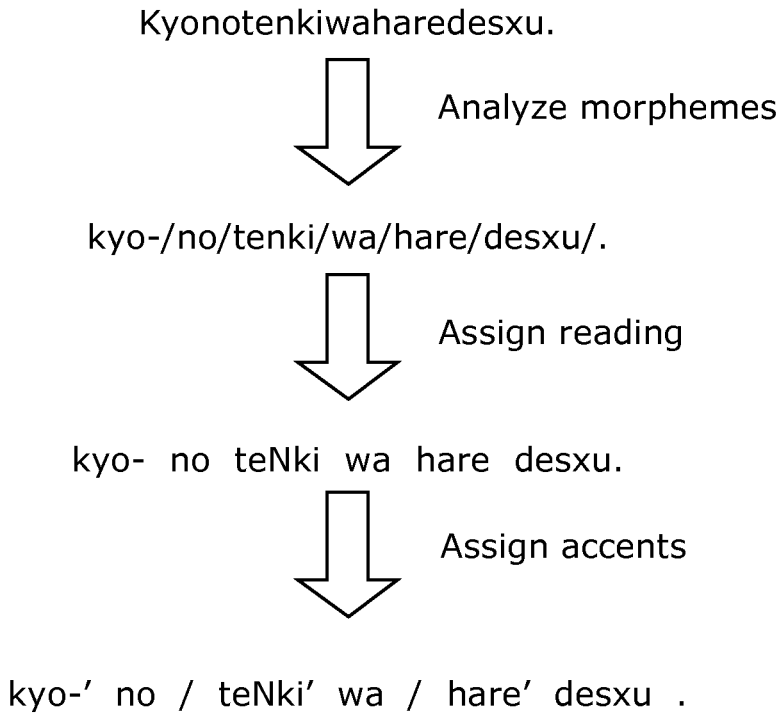
FIG. 7 is a diagram for describing a method of generating prosody information.

For example, when a sentence "kyonotenkiwaharedesxu." is input, the prosody generation unit 101 first divides the sentence into morphemes, as shown in FIG. 7. In dividing the sentence into morphemes, the prosody generation unit 101 also simultaneously analyzes part-of-speech information, etc., of each of the morphemes. The prosody generation unit 101 assigns reading information to the respective morphemes resulting from the dividing. The prosody generation unit 101 assigns accent phrases and accent positions to the assigned pieces of reading information. Thus, the prosody generation unit 101 obtains language information in the manner described above. The prosody generation unit 101 generates prosody information based on the obtained language information (phonetic symbol sequence, accent information, and so on). It should be noted that, in a case where language information is pre-assigned in the text, the above analyzing process is not necessary.

Prosody information refers to the duration, fundamental frequency pattern, power, or the like, of each phoneme.

In the generation of prosody information, there is, for example, a method which uses the quantization theory class I or a method of generating prosody information using the Hidden Markov Model (HMM).

For example, when generating the fundamental frequency pattern by using the quantization theory class I, the fundamental frequency pattern can be generated by using a fundamental frequency as a target variable and using a phoneme symbol sequence, an accent position, and so on, based on the input text as explanatory variables. In the same manner, by using the duration or power as a target variable, a duration pattern or power pattern can be generated.

[Mouth Opening Degree Generation Unit 102]

As described earlier, the inventors carefully observed the relationship between the difference in the utterance manners and the logarithmic vocal tract cross-sectional area functions and found a new link between the utterance manner and the volume of the oral cavity.

More specifically, when the volume of the oral cavity is larger, the utterance manner tends to be distinct and clear. In contrast, when the volume of the oral cavity is smaller, the utterance manner tends to be lazy and, accordingly, the clarity is low.

By using the oral cavity volume that can be calculated from the speech as an index of the mouth opening degree, the speech segment having the desired utterance manner can be found from the segment storage unit 103.

The mouth opening degree generation unit 102 generates, based on the input text, the mouth opening degree corresponding to the oral cavity volume. Specifically, the mouth opening degree generation unit 102 generates a temporal pattern for the variations in mouth opening degree, using a model indicating pre-learned temporal patterns for variations in mouth opening degree. The model is generated by extracting temporal patterns for variations in mouth opening degree from speech data of previously uttered speech, and learning based on the extracted temporal patterns and text information.

First, a method of calculating the mouth opening degree during model learning shall be described. Specifically, a method of separating speech into vocal tract information and voicing source information based on a vocal-tract/voicing-source model, and calculating the mouth opening degree from the vocal tract information shall be described.

When a linear predictive coding (LPC) model is used as the vocal-tract/voicing-source model, a sample value s(n) having a speech waveform (speech signal) is predicted from p number of preceding sample values. Here, the sample value s(n) can be expressed by Equation 1 as follows.

[Math. 1]

$$s(n) \cong \alpha_1 s(n-1) + \alpha_2 s(n-2) + \alpha_3 s(n-3) + \ldots + \alpha_p s(n-p) \qquad \text{(Equation 1)}$$

A coefficient $\alpha_i$ (i=1 to p) corresponding to the p number of sample values can be calculated using a correlation method, a covariance method, or the like. Using the calculated coefficient, an input speech signal is generated using Equation 2 as follows.

[Math. 2]

$$S(z) = \frac{1}{A(z)} U(z) \qquad \text{(Equation 2)}$$

Here, S(z) represents a value obtained by performing z-transformation on a speech signal s(n). Moreover, U(z) represents a value obtained by performing z-transformation on a voicing source signal u(n) and denotes a signal obtained by performing inverse filtering on the input speech S(z) using vocal tract characteristic 1/A(z).

In addition, a PARCOR coefficient (partial autocorrelation coefficient) may be calculated using a linear predictive coefficient $\alpha$ analyzed by LPC analysis. The PARCOR coefficient is known to have a more desirable interpolation property than the linear predictive coefficient. The PARCOR coefficient can be calculated using the Levinson-Durbin-Itakura algorithm. It should be noted that the PARCOR coefficient has the following features.

Feature 1: Variations in a lower order coefficient have a larger influence on a spectrum, and variations in a higher order coefficient have a smaller influence.

Feature 2: The variations in a higher order coefficient have influence evenly over an entire region.

In the following description, the PARCOR coefficient is used as the vocal tract characteristic. It should be noted that the vocal tract characteristic to be used here is not limited to the PARCOR coefficient, and the linear predictive coefficient may be used. Alternatively, a line spectrum pair (LSP) may be used.

Moreover, an autoregressive with exogenous input (ARX) model may be used as the vocal-tract/voicing source model. In this case, the input speech is separated into the vocal tract information and the voicing source information by way of ARX analysis. The ARX analysis is significantly different from the LPC analysis in that a mathematical voicing source model is used as the voicing source. Moreover, unlike the LPC analysis, the ARX analysis can separate the speech into the vocal tract information and the voicing source information more accurately even when an analysis-target period includes a plurality of fundamental periods ([Non Patent Literature (NPL) 3]: "Robust ARX-based speech analysis method taking voicing source pulse train into account" by Takahiro Ohtsuka and Hideki Kasuya, in The Journal of the Acoustical Society of Japan, 58 (7), 2002, pp. 386-397).

In the ARX analysis, a speech is generated by a generation process represented by Equation 3 below. In Equation 3, S(z) represents a value obtained by performing z-transformation on a speech signal s(n). U(z) represents a value obtained by performing z-transformation on a voiced source signal u(n), and E(z) represents a value obtained by performing z-transformation on an unvoiced noise source e(n). To be more specific, when the ARX analysis is executed, the voiced sound is generated by the first term on the right side of Equation 3 and the unvoiced sound is generated by the second term on the right side of Equation 3.

[Math. 3]

$$S(z) = \frac{1}{A(z)}U(z) + \frac{1}{A(z)}E(z) \quad \text{(Equation 3)}$$

At this time, as a model for the voiced source signal u(t) =u(nTs), a sound model represented by Equation 4 is used (Ts represents a sampling period).

[*Math.* 4]

$$u(t) = \begin{cases} 2a(t - OQ \times T0) - 3b(t - OQ \times T0)^2, & -OQ \times T0 < t \leq 0 \\ 0, & \text{elsewhere} \end{cases} \quad \text{(Equation 4)}$$

$$a = \frac{27AV}{4OQ^2T0}, \; b = \frac{27AV}{4OQ^3T0^2}$$

In Equation 4, AV represents a voiced source amplitude, TO represents a pitch period, and OQ represents the open quotient of the glottis (also referred to as "glottal OQ"). In the case of the voiced sound, the first term of Equation 4 is used, and, in the case of the unvoiced sound, the second term of Equation 4 is used. The glottal OQ indicates an opening ratio of the glottis in one pitch period. It is known that the speech tends to sound softer when the glottal OQ is larger.

The ARX analysis has the following advantages as compared with the LPC analysis.

Advantage 1: Since a voicing-source pulse train is arranged corresponding to the pitch periods in an analysis window to perform the analysis, the vocal tract information can be extracted with stability even from a high pitched speech of, for example, a female or child.

Advantage 2: U(z) can be obtained by performing the inverse filtering on the input speech S(z) using the vocal tract characteristic 1/A(z) as in the LPC analysis, especially in the voiced sound period where high performance can be expected in the separation of the input speech into the vocal tract information and the voicing sound information of a close vowel, such as /i/ or /u/, where a pitch frequency F0 and a first formant frequency F1 are close to each other.

The vocal tract characteristic 1/A(z) used in the ARX analysis has the same format as the system function used in the LPC analysis. On this account, a PARCOR coefficient may be calculated according to the same method used by the LPC analysis.

The mouth opening degree generation unit 102 calculates a mouth opening degree representing the oral cavity volume, using the vocal tract information obtained in the above-described manner. Specifically, mouth opening degree generation unit 102 calculates, using Equation 5, a vocal tract cross-sectional area function from the PARCOR coefficient extracted as the vocal tract characteristic.

[Math. 5]

$$\frac{A_i}{A_{i+1}} = \frac{1 - k_i}{1 + k_i} (i = 1, \ldots, N) \quad \text{(Equation 5)}$$

Here, $k_i$ represents an i-th order PARCOR coefficient, and $A_i$ represents an i-th vocal tract cross-sectional area, where $A_{N+1}=1$.

Figure 8:
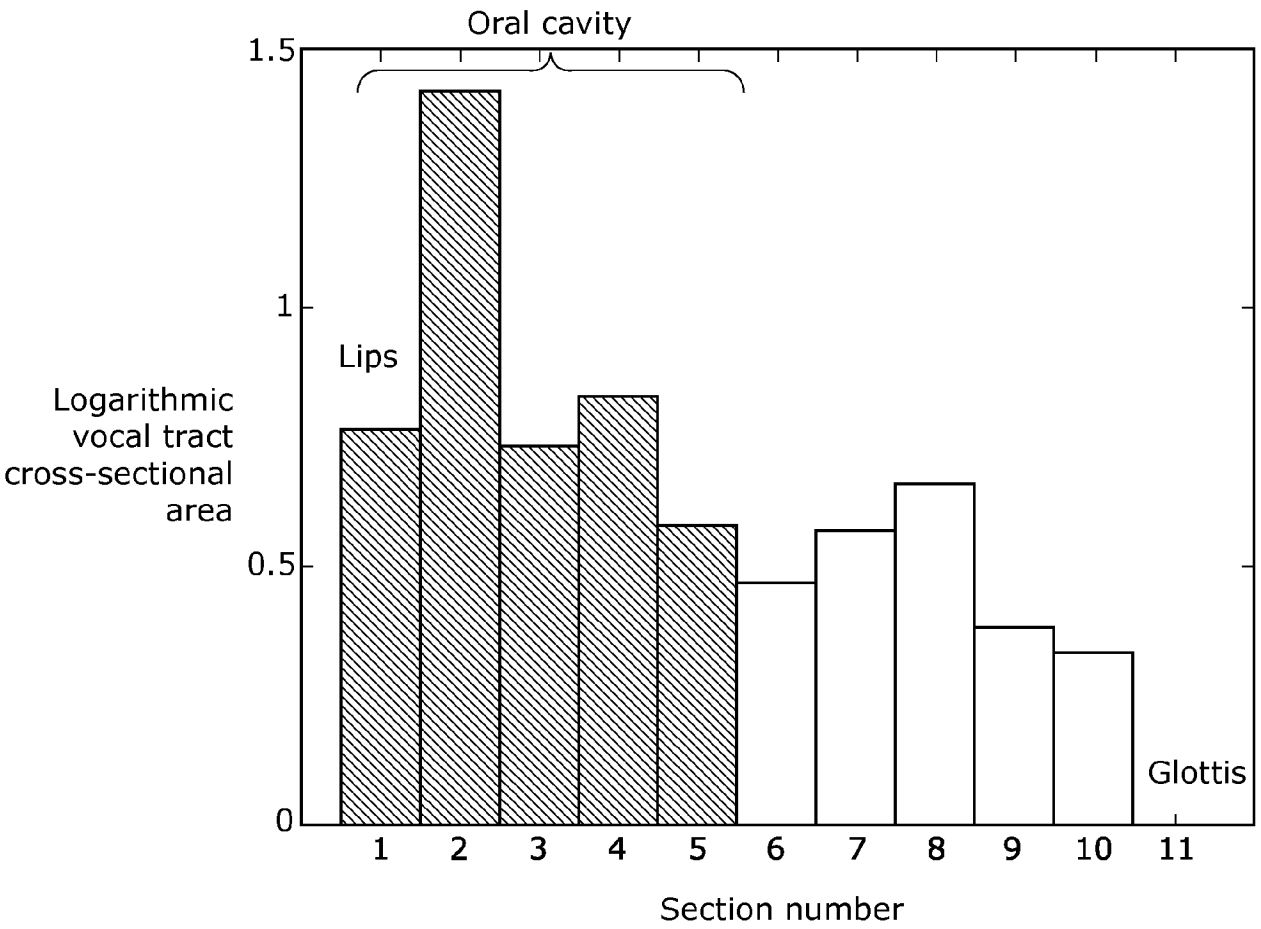
FIG. 8 is a graph showing an example of a vocal tract cross-sectional area function.

FIG. 8 is a diagram showing a logarithmic vocal tract cross-sectional area function of a vowel /a/ included in a speech. The vocal tract area is divided into eleven sections from the glottis to the lips (where N=10), Section 11 denotes the glottis and Section 1 denotes the lips.

In FIG. 8, a shaded area can be generally thought to be the oral cavity. When an area from Section 1 to Section T is the oral cavity (T=5 in FIG. 8), the mouth opening degree C. can be defined using Equation 6 as follows. Here, it is preferable for T to be changed depending on the order of the LPC analysis or the ARX analysis. For example, in the case of a 10th-order LPC analysis, it is preferable for T to be 3 to 5. However, note that the specific order is not limited.

[Math. 6]

$$C = \sum_{i=1}^{T} A_i \quad \text{(Equation 6)}$$

The mouth opening degree generation unit 102 calculates a mouth opening degree C. defined by Equation 6 for the uttered speech. In this way, by calculating the mouth opening degree (or, the oral cavity volume) using the vocal tract cross-sectional area function, consideration can be given not only to how much the lips are open but also to the shape of the oral cavity (a position of the tongue, for example) which cannot be observed directly from the outside.

Figure 9:
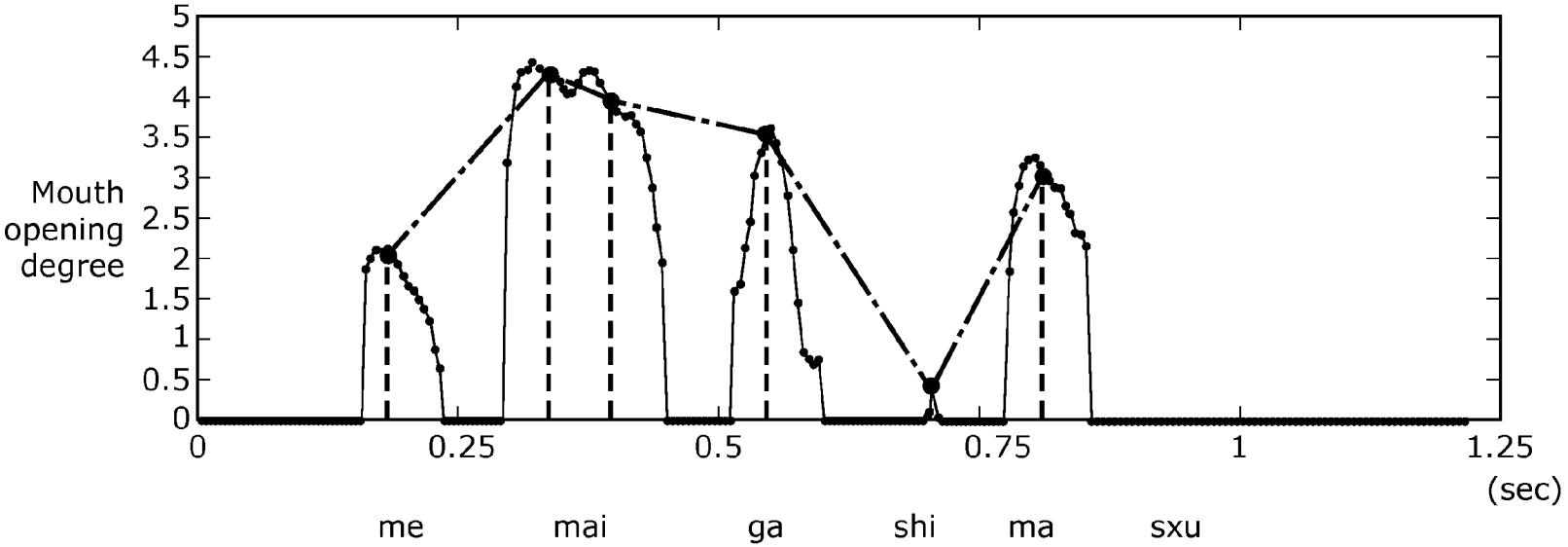
FIG. 9 is a graph showing a temporal pattern of mouth opening degrees for uttered speech

FIG. 9 shows temporal variations in the mouth opening degree calculated according to Equation 6, for the speech "/memaigasimasxu/".

The mouth opening degree generation unit 102 uses the mouth opening degree calculated in the above-described manner as a target variable, uses the information (for example, phoneme type, accent information, prosody information) obtainable from the input text as explanatory variables, and learns a mouth opening degree generation model in the same manner as the learning of prosody information such as fundamental frequency, and so on.

A method of generating the phoneme type, accent information, and prosody information from text shall be specifically described.

The input text is made up of plural characters. When text including plural sentences is input, the mouth opening degree generation unit 102 divides the text into individual sentences based on information such as periods, etc., and generates prosody on a per sentence basis. It should be noted that, even for text written in English, and so on, the mouth opening degree generation unit 102 also generates prosody by performing the process of dividing the text into individual sentences.

Furthermore, the mouth opening degree generation unit 102 linguistically analyzes a sentence, and obtains language information such as a phonetic symbol sequence and accents. The language information includes the number of mora counted from the beginning of the sentence, the number of mora counted from the end of the sentence, a position of a target accent phrase from the beginning of the sentence, a position of the target accent phrase from the end of the sentence, the accent type of the target accent phrase, distance from an accent position, and a part of speech of a target morpheme.

For example, when a sentence "kyonotenkiwaharedesxu." is input, the mouth opening degree generation unit 102 first divides the sentence into morphemes, as shown in FIG. 7. In dividing the sentence into morphemes, the mouth opening degree generation unit 102 also simultaneously analyzes part-of-speech information of each of the morphemes. The mouth opening degree generation unit 102 assigns reading information to the respective morphemes resulting from the dividing. The mouth opening degree generation unit 102 assigns accent phrases and accent positions to the assigned pieces of reading information. Thus, the mouth opening degree generation unit 102 obtains language information in the manner described above.

In addition, the mouth opening degree generation unit 102 uses, as explanatory variables, the prosody information (duration, intensity, and fundamental frequency of each phoneme) obtained by the prosody generation unit 101.

The mouth opening degree generation unit 102 generates mouth opening degree information based on the language information and the prosody information (phonetic symbol sequence, accent information, and so on) obtained in the manner described above. It should be noted that, in a case where language information and prosody information are pre-assigned in the text, the above analyzing process is not necessary.

The learning method is not particularly limited, and it is possible to learn the relationship between linguistic information extracted from text information and mouth opening degree, for example, by using the quantization theory class I.

A method of generating the mouth opening degree using the quantization theory class I shall be described below. The phoneme shall be used as the unit in which the mouth opening degree is generated. The unit is not limited to a phoneme, and a mora or a syllable may be used.

In the quantization theory class I, a quantity is learned for each category of the respective explanatory variables, and the quantity of a target variable is estimated as the summation of the quantities,

[Math. 7]

$$\hat{y}_i = \bar{y} + \sum_f \sum_c x_{fc}\delta_{fc}(i = 1, \ldots, N) \quad \text{(Equation 7)}$$

In Equation 7,

[Math. 8]

$$\hat{y}_i$$

is the estimated value of the mouth opening degree of the i-th phoneme, and

[Math. 9]

$$\bar{y}$$

is the average value of mouth opening degrees in the learning data. In addition, $x_{fc}$ is the quantity of a category c of an explanatory variable f, and $\delta_{fc}$ is a function which takes the value of 1 only when the explanatory variable f is classified as category c and takes the value of 0 in all other cases. By determining the quantity $x_{fc}$ based on learning data, a model can be learned.

As described earlier, the mouth opening degree varies relative to the phoneme type, accent information, prosody information, and other language information. In view of this, such information are used as explanatory variables. FIG. 10 shows an example of control factors used as explanatory variables and the categories thereof. The "phoneme type" is the type of the i-th phoneme in the text. The phoneme type is useful in estimating the mouth opening degree because the degree of opening of the lips or the degree of opening of the jaw, or the like, change depending on the phoneme. For example, /a/ is an open vowel, and thus the mouth opening degree tends to be large. Meanwhile, /i/ is a close vowel, and thus the mouth opening degree tends to be small. The "number of mora counted from beginning of sentence" is an explanatory variable indicating what place the mora including the target phoneme comes in (for example, the n-th mora) when counting moras from the beginning of the sentence. This is useful in estimating the mouth opening degree since the mouth opening degree tends to decrease from the beginning of a sentence to the end of the sentence in normal utterance. In the same manner, the "number of mora counted from end of sentence" is an explanatory variable indicating what place the mora including the target phoneme comes in (for example, the n-th mora) when counting moras from the end of the sentence, and is useful in estimating the mouth opening degree according to how dose the mora is to the end of the sentence. The "position of target accent phrase from beginning of sentence" and the "position of target accent phrase from end of sentence" indicate the mora position of the accent phrase including the target phoneme in the sentence. By using the position of the accent phrase, aside from the number of mora, linguistic influences can be further taken to consideration.

The "accent type of target accent phrase" indicates the accent type of the accent phrase including the target phoneme. Using the accent type allows the pattern of change of the fundamental frequency to be taken into consideration.

The "distance from accent position" indicates how many moras away from the accent position the target phoneme is. In the accent position, there is a tendency for emphasis in the utterance, and thus there is a tendency for the mouth opening degree to increase.

The "part-of-speech of target morpheme" is the part of speech of the morpheme including the target phoneme. A morpheme that can be a content word, such as a noun, verb, or the like, is likely to be emphasized. When emphasized, the mouth opening degree tends to increase, and thus the part of speech of the target morpheme is taken into consideration.

The "fundamental frequency of target phoneme" is the fundamental frequency when the target phoneme is uttered. The higher the fundamental frequency, the greater is the likelihood of being emphasized. For example, "<100" denotes a fundamental frequency of less than 100 Hz.

The "duration of target phoneme" is the duration when the target phoneme is uttered. A phoneme having longer duration is likely to be emphasized. For example, "<10" denotes a duration of less than 10 msec.

By learning the quantity $x_{fc}$ of the explanatory variable for estimating the mouth opening degree by using the above-described explanatory variables, the temporal pattern of the mouth opening degree can be estimated from the input text, and the utterance manner that the synthetic speech should have can be estimated. Specifically, the mouth opening degree generation unit 102 calculates the mouth opening degree which is the value of the target variable, by substituting values in the explanatory variables in Equation 7. The values of the explanatory variables are generated by the prosody generation unit 101.

It should be noted that explanatory variables are not limited to those described above, and an explanatory variable that influences the change in mouth opening degree may be added.

It should be noted that the method of calculating the mouth opening degree is not limited to the method described above. For example, the shape of the vocal tract may be extracted using magnetic resonance imaging (MRI) at the time of speech utterance, and the mouth opening degree may be calculated from the extracted vocal tract shape, using the volume of the sections corresponding to the oral cavity, in the same manner as in the above-described method. Alternatively, magnetic markers may be attached within the oral cavity at the time of utterance, and the mouth opening degree, which is the volume of the oral cavity, may be estimated from the position information of the magnetic markers.

[Segment Storage Unit 103]

The segment storage unit 103 stores pieces of segment information including speech segments and mouth opening degrees. The speech segments are stored in units such as phonemes, syllables, or moras. In the subsequent description, description shall be carried out with the phoneme as the unit for the speech segment. The segment storage unit 103 stores pieces of segment information having the same phoneme type and different mouth opening degrees.

The pieces of information on the speech segments that are stored in the segment storage unit 103 are speech waveforms. Furthermore, the information on the speech segments is separated into vocal tract information and voicing source information, based on the aforementioned vocal-tract/voicing-source model. The mouth opening degree corresponding to each speech fragment can be calculated using the above-described method.

Figure 11:
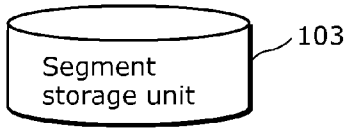
FIG. 11 is a diagram showing an example of segment information stored in a segment storage unit.

FIG. 11 shows an example of segment information stored in the segment storage unit 103. In FIG. 11, the pieces of segment information with phoneme numbers 1 and 2 are of the same phoneme type /a/. Meanwhile, with respect to the mouth opening degree 10 for phoneme number 1, the opening mouth degree for phoneme number 2 is 12. As described above, the segment storage unit 103 stores pieces of segment information having the same phoneme type and different mouth opening degrees. However, it is not necessary to store segment information having different mouth opening degrees for all the phoneme types.

Specifically, the segment storage unit 103 stores: a phoneme number for identifying the segment information; a phoneme type; vocal tract information (PARLOR coefficient) which is a speech segment; a mouth opening degree; a phoneme environment which is a speech segment; voicing source information of a predetermined section which is a speech segment; prosody information which is a speech segment; and a duration. The phoneme environment includes, for example, preceding or following phoneme information, preceding or following syllable information, or an articulation point of the preceding or following phoneme. In FIG. 11, the preceding or following phoneme information is shown. The voicing source information includes a spectral tilt and glottal OQ. The prosody information includes a fundamental frequency (FO), power, and so on.

[Agreement Degree Calculation Unit 104]

The agreement degree calculation unit 104 identifies, from among the pieces of segment information stored in the segment storage unit 103, a piece of segment information having a phoneme type is the same as the type of the phoneme included in the input text. The agreement degree calculation unit 104 calculates a mouth opening degree agreement degree (hereafter also referred to simply as "agreement degree") $S_{ij}$ which is the degree of agreement between the mouth opening degree included in the identified segment information and the mouth opening degree generated by the mouth opening degree generation unit 102. The agreement degree calculation unit 104 is connected by wire or wirelessly to the segment storage unit 103, and transmits and receives information including segment information, and so on. The agreement degree $S_{ij}$ can be calculated as follows. A smaller value for the agreement degree $S_{ij}$, shown below indicates higher agreement between a mouth opening degree $C_i$ and a mouth opening degree $C_j$.

(1) Difference Between Mouth Opening Degrees

The agreement degree calculation unit 104 calculates, for each phoneme generated from the input text, the agreement degree $S_{ij}$ from the difference between the mouth opening degree $C_i$ calculated by the mouth opening degree generation unit 102 and the mouth opening degree $C_j$ included in the segment information stored in the segment storage unit 103 and having the phoneme type that is the same as the type of a the target phoneme, as shown in Equation 8.

[Math. 10]

$$S_{ij}=|C_i-C_j| \quad \text{(Equation 8)}$$

(2) Normalization on a Per Vowel Basis

Furthermore, the agreement degree calculation unit 104 may calculate the mouth opening degree for each phoneme generated from the input text, according to Equation 9 and Equation 10 below, Specifically, the agreement degree calculation unit 104 calculates a phoneme-normalized mouth opening degree $C_i^P$ by normalizing the mouth opening degree $C_i$ calculated by the mouth opening degree generation unit 102, using the average value and standard deviation of the mouth opening degree of the target phoneme, as shown in Equation 10. Furthermore, the agreement degree calculation unit 104 calculates a phoneme-normalized mouth opening degree $C_j^P$ by normalizing the mouth opening degree $C_j$ included in the segment information stored in the segment storage unit 103 and having the phoneme type that is the same as the type of a the target phoneme, using the average value and standard deviation of the mouth opening degree of the target phoneme. The agreement degree calculation unit 104 calculates the agreement degree $S_{ij}$ using the difference between the phoneme-normalized mouth opening degree $C_i^P$ and the phoneme-normalized mouth opening degree $C_j^P$.

[Math. 11]

$$S_{ij} = |C_i^P - C_j^P| \quad \text{(Equation 9)}$$

[Math. 12]

$$C_i^P = \frac{|C_i - E^i|}{V^i} \quad \text{(Equation 10)}$$

Here, $E^i$ denotes an average of the mouth opening degree of the i-th phoneme, and $V^i$ denotes the standard deviation of the mouth opening degree of the i-th phoneme.

It should be noted that the phoneme-normalized mouth opening degree $C_j^P$ may be stored in advance in the segment storage unit 103. In this case, the need for the agreement degree calculation unit 104 to calculate the phoneme-normalized mouth opening degree $C_j^P$ is eliminated.

(3) Seeing the Variation

Furthermore, the agreement degree calculation unit 104 may calculate the mouth opening degree for each phoneme generated from the input text, according to Equation 9 and Equation 10.

Specifically, the agreement degree calculation unit 104 calculates a mouth opening degree difference (hereafter referred to simply as "degree difference") $C_i^D$ which is the difference between the mouth opening degree $C_i$ generated by the mouth opening degree generation unit 102 and the mouth opening degree of the preceding phoneme, as shown in Equation 11. Furthermore, the agreement degree calculation unit 104 calculates a degree difference $C_j^D$ which is the difference between the mouth opening degree $C_j$ of data stored in the segment storage unit 103 and having a phoneme type that is the same as the type of the target phoneme and the mouth opening degree of the preceding phoneme of the target phoneme. The agreement degree calculation unit 104 calculates the agreement degree between the mouth opening degrees using the difference between the degree difference $C_i^D$ and the degree difference $C_j^D$.

[Math. 13]

$$S_{ij}=|C_i^D-C_j^D| \quad \text{(Equation 11)}$$

It should be noted that the agreement degree between mouth opening degrees may be calculated by combining the above-described methods. Specifically, the agreement degree between mouth opening degrees may be calculated using the weighted sum of the aforementioned agreement degrees.

[Segment Selection Unit 105]

The segment selection unit 105 selects, for each phoneme generated from the input text, segment information corresponding to the target phoneme from among the pieces of segment information stored in the segment storage unit 103, based on the type and opening mouth degree of the target phoneme.

Specifically, the segment selection unit 105 selects, for each phoneme corresponding to the input text, a speech segment from the segment storage unit 103 by using the agreement degree calculated by the agreement degree calculation unit 104.

Specifically, for a phoneme sequence in the input text, the segment selection unit 105 selects, from the segment storage unit 103, a speech segment for which an agreement degree $S_{i,j(i)}$ calculated by the agreement degree calculation unit 104 and an inter-neighboring segment concatenation cost $C^C_{j(i-1),j(i)}$ are minimum, as shown in Equation 12. Having minimum concatenation cost means a high degree of similarity.

Assuming consecutive speech segments as $u_{j(i-1)}$ and $u_{j(i)}$, the inter-neighboring segment concatenation cost $C^C_{j(i-1),j(i)}$ can be calculated, for example, based on the consecutiveness of the end of $u_{j(i-1)}$ and the beginning of $u_{j(i)}$. The method of calculating the concatenation cost is not particularly limited, and can be calculated, for example, by using a cepstral distance of the concatenation positions of speech segments.

[Math. 14]

$$j(i) = \underset{j}{\operatorname{argmin}}\left[\sum_{i=1}^{N}\left(S_{i,j(i)} + C^C_{j(i-1),j(i)}\right)\right] \quad \text{(Equation 12)}$$

In Equation 12, "i" is the i-th phoneme included in the input text, N is the number of phonemes in the input text, and j(i) represents the segment selected as the i-th phoneme.

It should be noted that, in the case where the vocal tract characteristic and the parameter of the voicing source characteristic analyzed using the aforementioned vocal-tract/voicing-source model are included in segment information stored in the segment storage unit 103, speech segments can be consecutively concatenated by inter-analysis parameter interpolation. As such, since the concatenation of speech segments can be performed relatively easily with little sound quality deterioration, segment selection may be performed using only the mouth opening degree agreement degree. Specifically, the speech segment sequence j(i) shown in Equation 13 is selected.

[Math. 15]

$$j(i) = \underset{j}{\operatorname{argmin}}\left[\sum_{i=1}^{N} S_{i,j(i)}\right] \quad \text{(Equation 13)}$$

In addition, by quantizing the mouth opening degrees stored in the segment storage unit 103, the segment selection unit 105 may uniquely select, from the segment storage unit 103, the speech segment corresponding to the mouth opening degree generated by the mouth opening degree generation unit 102.

[Synthesis Unit 106]

The synthesis unit 106 generates synthetic speech that reads aloud the inputted text (synthetic speech of the text), by using the speech segments selected by the segment selection unit 105 and the pieces of prosody information generated by the prosody generation unit 101.

When the speech segments included in the pieces of segment information stored in the segment storage unit 103 are speech waveforms, synthesis is performed by concatenating speech waveforms. The method of concatenation is not particularly limited, and it is sufficient, for example, to perform the concatenation at a concatenation point where distortion during the concatenation of speech segments is minimal. It should be noted that, during the concatenation of speech segments, the speech segment sequence selected by the segment selection unit 105 may be concatenated as they are, or after the respective speech segments are modified in conformance to the prosody information generated by the prosody generation unit 101.

Alternatively, when the segment storage unit 103 stores, as speech segments, pieces of vocal tract information and pieces of voicing source information based on the vocal-tract/voicing-source model, the synthesis unit 106 concatenates each of the pieces of vocal tract information and pieces of voicing source information to synthesize speech. The synthesis method is not particularly limited, and PARCOR synthesis may be used when the PARCOR coefficient is used as speech information. Alternatively, speech synthesis may be performed after the PARCOR coefficient is converted into the LPC coefficient, or speech synthesis may be performed by extracting formants and performing formant synthesis. In addition, speech synthesis may be performed by calculating an LPC coefficient from the PARCOR coefficient, and performing LSP synthesis.

It should be noted that speech synthesis may be performed after the vocal tract information and voicing source information are modified in conformance to the prosody information generated by the prosody generation unit 101. In this case, synthetic speech having high sound quality can be obtained even when the segments stored in the segment storage unit 103 are small in number.

(Flowchart)

Figure 12:
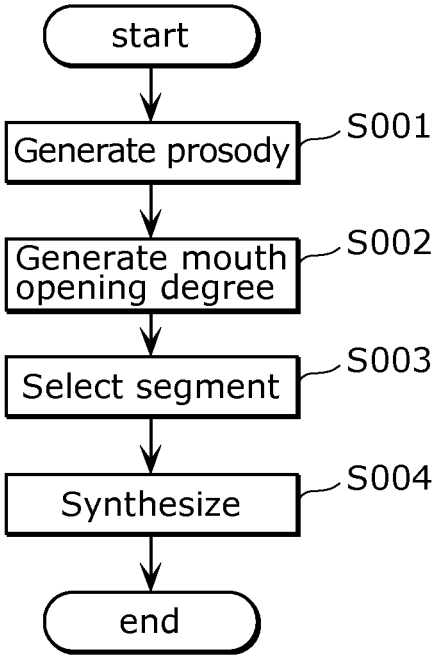
FIG. 12 is a flowchart showing an operation of the speech synthesis device in Embodiment 1.

A specific operation performed by the speech synthesis device according to this embodiment shall be described using the flowchart shown in FIG. 12.

In step S001, the prosody generation unit 101 generates pieces of prosody information based on input text.

In step S002, the mouth opening degree generation unit 102 generates, based on the input text, a temporal pattern of mouth opening degrees of a phoneme sequence included in the input text.

In step S003, the agreement degree calculation unit 104 calculates the agreement degree between the mouth opening degree of each of the phonemes of the phoneme sequence included in the input text, calculated in step S002 and the mouth opening degrees in the pieces of segment information stored in the segment storage unit 103. Furthermore, the segment selection unit 105 selects a speech segment for each of the phonemes of the phoneme sequence included in the input text, based on the calculated agreement degree and/or the prosody information calculated in step S001.

In step S004, the synthesis unit 106 synthesizes speech by using the speech segment sequence selected in step S003.

(Effect)

According to the above-described configuration, in the synthesizing of speech from input text, it is possible to synthesize speech while maintaining the input text-based temporal variation in utterance manner. Consequently, since the input text-based temporal pattern of the variation in utterance manner is maintained in the synthetic speech, deterioration of naturalness (fluency) during synthesis is reduced.

For example, as shown in (a) in FIG. 3, since the input text-based variation in utterance manner (clarity) of each phoneme and the variation in utterance manner (temporal pattern such as distinct and lazy) of the synthetic speech become the same as the variation in utterance manner learned from speech that is actually uttered, it is possible to reduce sound quality deterioration caused by unnaturalness of utterance manner.

Furthermore, since the oral cavity volume (the mouth opening degree) is used as a criterion of selecting a speech segment, there is the effect of being able to reduce the amount of data stored in the segment storage unit 103 as compared with the case where linguistic and physiological conditions are directly considered in constructing the segment storage unit 103.

It should be noted that although this embodiment has described the case of speech in Japanese, the present disclosure is not limited to the Japanese language, and the speech synthesis can be similarly performed in other languages including English.

For example, compare the following uttered sentences when uttered naturally: "Can I make a phone call from this plane?"; and "May I have a thermometer?". Here, [ei] in "plane" at the end of the first sentence is different in utterance manner from [ei]/e/ in "May" at the beginning of the second sentence ([ ] denotes the phonetic notation according to the International Phonetic Alphabet). As is the case with Japanese, the utterance manner in English also changes depending on a position in the sentence, type such as content word or function word, or the presence or absence of emphasis. On account of this, when the speech segment is selected based on the conventional phoneme environment or prosody information, the input text-based temporal variation of the utterance manner is disturbed as in the case of Japanese, which results in deterioration in naturalness of synthetic speech. Therefore, by selecting the speech segment based on the mouth opening degree in the case of the English language as well, speech can be synthesized while maintaining the input text-based temporal variation in the utterance manner. Consequently, since the input text-based temporal pattern of the variation in utterance manner is maintained in the resultant synthetic speech, it is possible to perform speech synthesis in which deterioration of naturalness (fluency) is reduced.

(Modification 1 of Embodiment 1)

Figure 13:
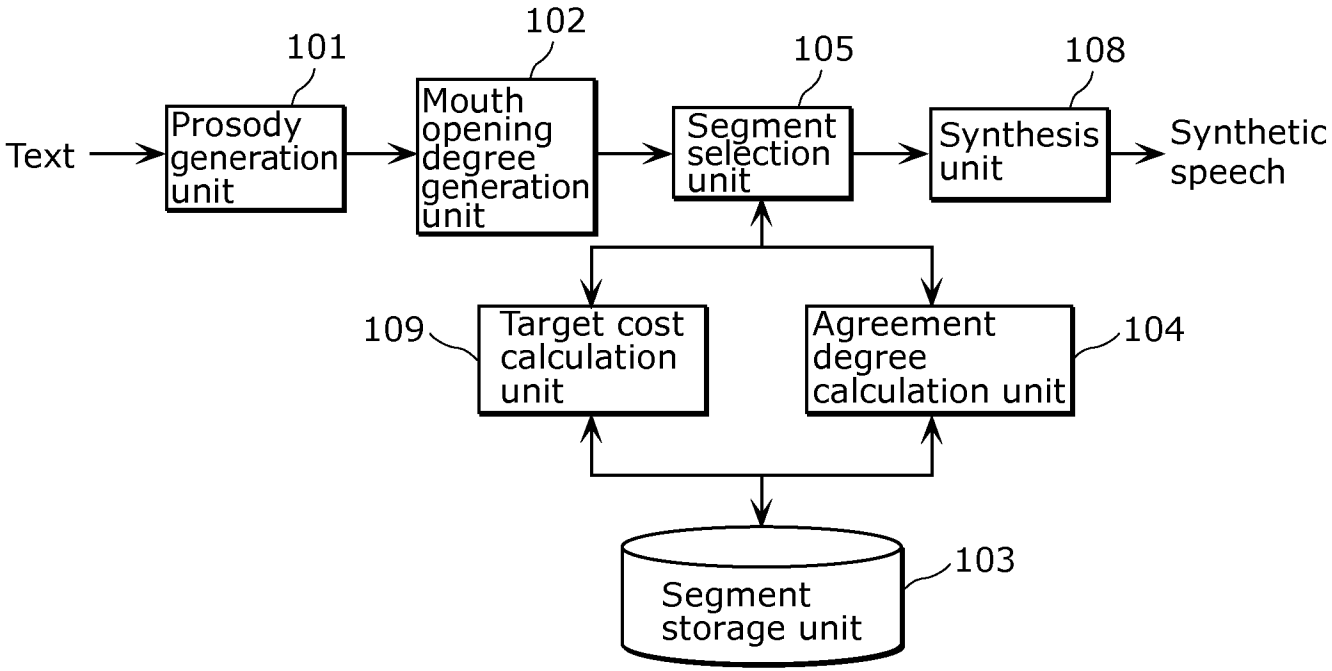
FIG. 13 is a configuration diagram of a speech synthesis device according to Modification 1 of Embodiment 1.

FIG. 13 is a configuration diagram showing a modification of the speech synthesis device in Embodiment 1. It should be noted that, in FIG. 13, structural elements that are the same as those in FIG. 6 are assigned the same reference signs as in FIG. 6 and their description shall not be repeated.

Specifically, the speech synthesis device according to Modification 1 of Embodiment 1 has a configuration in which a target cost calculation unit 109 is added to the configuration of the speech synthesis device shown in FIG. 6.

The difference in this modification is that, when the segment selection unit 105 selects a segment sequence from the segment storage unit 103, each of the speech segments is selected based, not only on the agreement degree calculated by the mouth opening degree calculation unit 104, but also on the degree of similarity between the phoneme environment of the phoneme and prosody information included in the input speech and the phoneme environment of each phoneme and the prosody information included in the segment storage unit 103.

[Target Cost Calculation Unit 109]

The target cost calculation unit 109 calculates, for each of the phonemes included in the input text, a cost based on the degree of similarity between (i) the phoneme environment of the phonemes and the prosody information generated by the prosody generation unit 101, and (ii) the phoneme environment of the segment information and the prosody information included in the segment storage unit 103.

Specifically, the target cost calculation unit 109 calculates the cost by calculating the degree of similarity in phoneme type of the preceding and following phonemes and the target phoneme. For example, when the types of the preceding phoneme of a phoneme included in the input text and the preceding phoneme in the phoneme environment of the piece of segment information having the same phoneme type as the target phoneme do not agree with each other, the target cost calculation unit 109 adds a cost d as a penalty. Similarly, when the types of the following phoneme of the phoneme included in the input text and the following phoneme in the phoneme environment of the piece of segment information having the same phoneme type as the target phoneme do not agree with each other, the target cost calculation unit 109 adds the cost d as a penalty. The cost d need not be the same value for preceding phonemes and following phonemes, and the agreement degree between preceding phonemes may be prioritized. Alternatively, even when the preceding phonemes do not agree with each other, the size of penalty may be changed according to the degree of similarity between the phonemes. For example, when the phonemes belong to the same phoneme category (plosive, fricative, or the like), the penalty may be set to be smaller. Moreover, when the phonemes are the same in the place of articulation (for an alveolar or palatal sound, for example), the penalty may be set to be smaller. In this manner, the target cost calculation unit 109 calculates a cost $C_{ENV}$ indicating the agreement between the phoneme environment of a phoneme included in the input text and the phoneme environment of a corresponding piece of segment information included in the segment storage unit 103.

Furthermore, with regard to the prosody information, the target cost calculation unit 109 calculates costs $C_{F0}$, $C_{DUR}$, and $C_{POW}$ using the differences between the fundamental frequency, duration, and power calculated by the prosody generation unit 101 and the fundamental frequency, duration, and power in the piece of segment information stored in the segment storage unit 101

The target cost calculation unit 109 calculates the target cost by weighted summation of the respective costs as shown in Equation 14. The method of setting the weights p1, p2, and p3 is not particularly limited.

[Math. 16]

$$D_{i,j}=C_{ENV}+p_1C_{F0}+p_2C_{DUR}+p_3C_{POW} \quad \text{(Equation 14)}$$

[Segment Selection Unit 105]

The segment selection unit 105 selects, for each phoneme, a speech segment sequence from the segment storage unit 103, by using the agreement degree calculated by the agreement degree calculation unit 104, the cost calculated by the target cost calculation unit 109, and the inter-speech segment concatenation cost.

Specifically, for a vowel sequence of the input speech, the segment selection unit 105 selects, from the segment storage unit 103, a speech segment sequence j(i)(i=1, . . . , N) for which the agreement degree $S_{ij}$ calculated by the agreement degree calculation unit 104, the target cost $D_{ij}$ calculated by the target cost calculation unit 109, and the inter-neighboring segment concatenation cost are minimum, as shown in Equation 15.

Assuming consecutive speech segments as $u_i$ and $u_j$, an inter-neighboring segment concatenation cost $C^C$ can be calculated, for example, based on the consecutiveness of the end of $u_i$ and the beginning of $u_j$. The method of calculating the concatenation cost is not particularly limited, and can be calculated, for example, by using a cepstral distance of the concatenation positions of speech segments.

[Math. 17]

$$j(i) = \underset{j}{\operatorname{argmin}}\left[\sum_{i}^{N}(S_{i,j} + w_1 \times D_{i,j} + w_2 C^{C}_{j(i-1),j(i)})\right] \quad \text{(Equation 15)}$$

The method of setting the weights $w_1$ and $w_2$ are not particularly limited, and may be determined in advance as appropriate. It should be noted that the weights may be adjusted according to the size of data stored in the segment storage unit 103. Specifically, the weight $w_1$ of the cost calculated by the target cost calculation unit 109 may set to be smaller when the pieces of segment information stored in the segment storage unit 103 are larger in number, and the weight $w_1$ of the cost calculated by the target cost calculation unit 109 may set to be smaller when the pieces of segment information stored in the segment storage unit 103 are smaller in number.

With the above-described configuration, the phonetic characteristics of the input speech and the temporal variation of the original utterance manner can be maintained during the synthesizing of speech. As a result, since the phonetic characteristics of the respective phonemes in the input speech and the temporal variation of the original utterance manner are maintained, speech synthesis having high sound quality and reduced deterioration of naturalness (fluency) becomes possible.

Furthermore, since this configuration allows for speech synthesis that does not lose the temporal variation of the original utterance manner even when the pieces of segment information stored in the segment storage unit 103 are small in number, the configuration is highly useful in various modes of use.

Furthermore, when the segment selection unit 105 selects the speech segment sequence, the weight is adjusted according to the number of pieces of segment information stored in the segment storage unit 103 (when the pieces of segment information stored in the segment storage unit 103 are smaller in number, the weight assigned to the cost calculated by the target cost calculation unit 109 is set to be smaller). With this, when the pieces of segment information stored in the segment storage unit 103 are small in number, a higher priority is given to the agreement degree between the mouth opening degrees. Thus, even when none of the stored speech segments has a high degree of similarity in phoneme environment, or the like, with the input speech, by selecting the speech segment having a mouth opening degree with a high degree of agreement with the mouth opening degree of the input speech, the utterance manner of the resultant synthetic speech agrees with the utterance manner of the input speech. Accordingly, since it is possible to reproduce a temporal variation in utterance manner that is natural as a whole, a resultant synthetic speech with a high degree of naturalness can be obtained.

On the other hand, when the pieces of segment information stored in the segment storage unit 103 are large in number, the speech segment is selected in consideration of both the cost and the degree of agreement between the mouth opening degrees. As such, the mouth opening degree can be further considered in addition to the consideration given to the phoneme environment. As a result, as compared to selecting with the conventional selection criterion, the temporal variation of a natural utterance manner can be reproduced and, therefore, a resultant synthetic speech with a high degree of naturalness can be obtained.

(Modification 2 of Embodiment 1)

Figure 14:
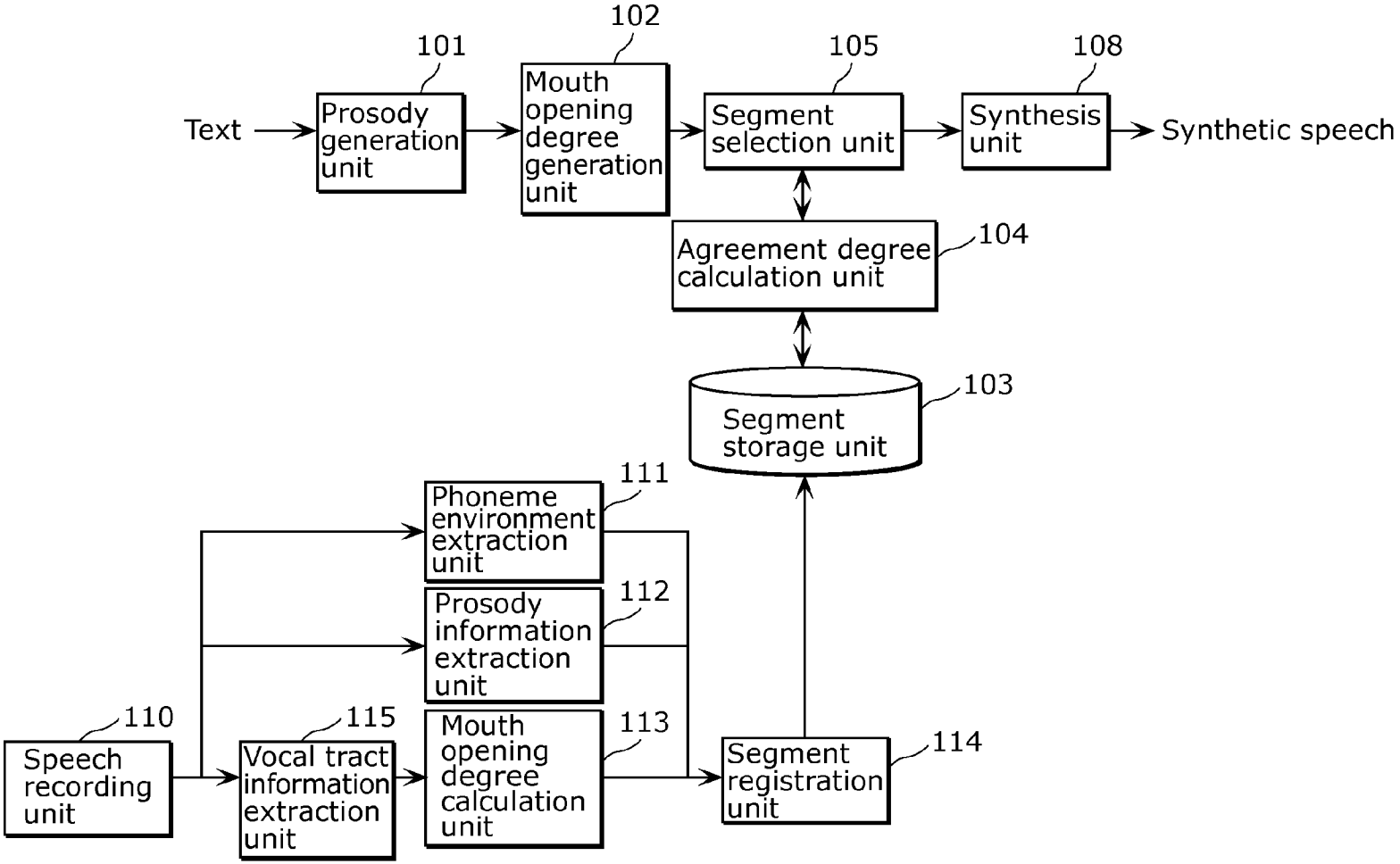
FIG. 14 is a configuration diagram of a speech synthesis device according to Modification 2 of Embodiment 1.

FIG. 14 is a configuration diagram showing another modification of the speech synthesis device in Embodiment 1. In FIG. 14, structural elements that are the same as those in FIG. 6 are assigned the same reference signs as in FIG. 6 and their description shall not be repeated.

Specifically, the speech synthesis device according to Modification 2 of Embodiment 1 has a configuration in which a speech recording unit 110, a phoneme environment extraction unit 111, a prosody information extraction unit 112, a vocal tract information extraction unit 115, a mouth opening degree calculation unit 113, and a segment registration unit 114 are added to the configuration of the speech synthesis device shown in FIG. 6. In other words, the further inclusion of a processing unit for constructing the segment storage unit 103 in this modification is the point of difference with Embodiment 1.

The speech recording unit 110 records a speech of a speaker. The phoneme environment extraction unit 111 extracts, for each of phonemes included in the recorded speech, the phoneme environment including the phoneme type of the preceding and following phonemes. The prosody information extraction unit 112 extracts, for each of the phonemes included in the recorded speech, prosody information including duration, fundamental frequency, and power. The vocal tract information extraction unit 115 extracts vocal tract information from the speech of the speaker. The mouth opening degree calculation unit 113 calculates, for each of the phonemes included in the recorded speech, a mouth opening degree from the vocal tract information extracted by the vocal tract information extraction unit 115. The method of calculating the mouth opening degree is the same as the method of calculating the mouth opening degree when the mouth opening degree generation unit 102 generates the model indicating the temporal pattern of the variation of the mouth opening degree in Embodiment 1.

The segment registration unit 114 registers the information obtained by the phoneme environment extraction unit 111, the prosody information extraction unit 112, and the mouth opening degree calculation unit 113, in the segment storage unit 103, as segment information.

Figure 15:
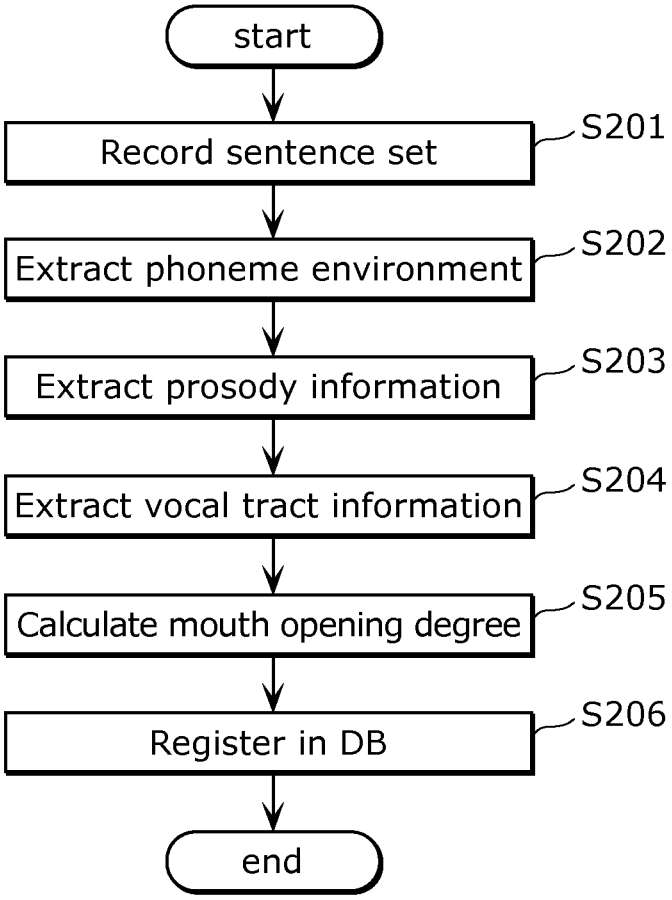
FIG. 15 is a flowchart showing an operation of the speech synthesis device according to Modification 2 of Embodiment 1.

The method of creating the segment information to be registered in the segment storage unit 103 shall be described using the flowchart in FIG. 15.

In step S201, the speaker is asked to utter sentences, and the speech recording unit 110 records the speech of the sentence set. Although the number of sentences is not limited, the speech recording unit 110 records, for example, speech in the scale of several hundreds of sentences to several thousands of sentences. The scale of the speech to be recorded is not particularly limited.

In step S202, the phoneme environment extraction unit 111 extracts, for each of phonemes included in the recorded sentence set, the phoneme environment including the phoneme type of the preceding and following phonemes.

In step S203, the prosody information extraction unit 112 extracts, for each of the phonemes included in the recorded sentence set, prosody information including duration, fundamental frequency, and power.

In step S204, the vocal tract information extraction unit 115 extracts a piece of vocal tract information, for each of the phonemes included in the recorded sentence set.

In step S205, the mouth opening degree calculation unit 113 calculates the mouth opening degree, for each of the phonemes included in the recorded sentence set. Specifically, the mouth opening degree calculation unit 113 calculates the mouth opening degree using the corresponding piece of vocal tract information. In other words, the mouth opening degree calculation unit 113 calculates, from the piece of vocal tract information extracted by the vocal tract information extraction unit 115, a vocal tract cross-sectional area function indicating the cross-sectional areas of the vocal tract, and calculates, as the mouth opening degree, the sum of the vocal tract cross-sectional areas indicated by the calculated vocal tract cross-sectional area function. The mouth opening degree calculation unit 113 may calculate, as the mouth opening degree, the sum of the vocal tract cross-sectional areas from a section corresponding to the lips up to a predetermined section, indicated by the calculated vocal tract cross-sectional area function.

In step S206, the segment registration unit 114 registers, in the segment storage unit 103, the information obtained in steps S202 to S205 and the speech segments (for example, speech waveforms) of the phonemes included in the speech recorded by the speech recording unit 110.

It should be noted that the order for executing the processes in steps S202 to S205 need not be the above-described order.

According to the above-described process, the speech synthesis device can record the speech of the speaker and create the segment storage unit 103, and thus the quality of the resulting synthetic speech can be updated whenever necessary.

Using the segment storage unit 103 created in the above-described manner, the phonetic characteristics of the input speech and the temporal variation of the original utterance manner can be maintained during the synthesizing of speech from the input text. As a result, since the phonetic characteristics of the respective vowels in the input speech and the temporal variation of the original utterance manner can be maintained, speech synthesis having high sound quality and reduced deterioration of naturalness (fluency) becomes possible.

Although the speech synthesis device has been described thus far according to an exemplary embodiment and modifications thereof, the present disclosure is not limited to such embodiment and modifications.

For example, the respective devices described above may be specifically configured as a computer system made up of a microprocessor, a ROM, a RAM, a hard disk drive, a display unit, a keyboard, a mouse, and so on. A computer program is stored in the RAM or the hard disk drive. The respective devices achieve their functions by way of the microprocessor operating according to the computer program. Here, the computer program is configured of a combination of command codes indicating commands to the computer in order to achieve a predetermined function.

For example, the computer program causes a computer to execute: generating, for each of phonemes generated from the text, a piece of prosody information by using the text; generating, for each of the phonemes generated from the text, a mouth opening degree corresponding to an oral cavity volume, using information generated from the text and indicating a type of the phoneme and a position of the phoneme within the text, the mouth opening degree to be generated being larger for a phoneme positioned at a beginning of a sentence in the text than for a phoneme positioned at an end of the sentence; selecting, for each of the phonemes generated from the text, a piece of segment information corresponding to the phoneme from among pieces of segment information stored in a segment storage unit, based on the type of the phoneme and the generated mouth opening degree, each of the pieces of segment information including a phoneme type, information on a mouth opening degree, and speech segment data; and generating the synthetic speech of the text, using the selected piece of segment information and the generated prosody information.

Moreover, some or all of the structural elements included in each of the above-described devices may be realized as a single system Large Scale Integration (LSI). The system LSI is a super multifunctional LSI manufactured by integrating a plurality of components onto a signal chip. More specifically, the system LSI is a computer system configured with a microprocessor, a ROM, a RAM, and so forth. The RAM stores a computer program. The microprocessor operates according to the computer program, so that a function of the system LSI is carried out.

Furthermore, some or all of the structural elements included in each of the above-described devices may be implemented as an IC card or a standalone module that can be inserted into and removed from the corresponding device. The IC card or the module is a computer system configured with a microprocessor, a ROM, a RAM, and so forth. The IC card or the module may include the aforementioned super multifunctional LSI. The microprocessor operates according to the computer program, so that a function of the IC card or the module is carried out. The IC card or the module may be tamper resistant.

Moreover, one or more exemplary embodiments may be the methods described above. Each of the methods may be a computer program implemented by a computer, or may be a digital signal of the computer program.

Furthermore, one or more exemplary embodiments may be the aforementioned computer program or digital signal recorded on a non-transitory computer-readable recording medium, such as a flexible disk, a hard disk, a CD-ROM, an MO, a DVD, a DVD-ROM, a DVD-RAM, a Blu-ray Disc (BD) (registered trademark), or a semiconductor memory. Also, one or more exemplary embodiments may be the digital signal recorded on such non-transitory recording mediums.

Moreover, one or more exemplary embodiments may be the aforementioned computer program or digital signal transmitted via a telecommunication line, a wireless or wired communication line, a network represented by the Internet, and data broadcasting.

Furthermore, one or more exemplary embodiments may be a computer system including a microprocessor and a memory. The memory may store the aforementioned computer program and the microprocessor may operate according to the computer program.

Moreover, by transferring the non-transitory recording medium having the aforementioned program or digital signal recorded thereon or by transferring the aforementioned program or digital signal via the aforementioned network or the like, one or more exemplary embodiments may be implemented by a different independent computer system.

Furthermore, various modifications to exemplary embodiments that may be conceived by a person of ordinary skill in the art or those forms obtained by combining structural elements in the different embodiments, for as long as they do not depart from the essence of the appended Claims, are intended to be included in the scope of the appended Claims.

Figure 16:
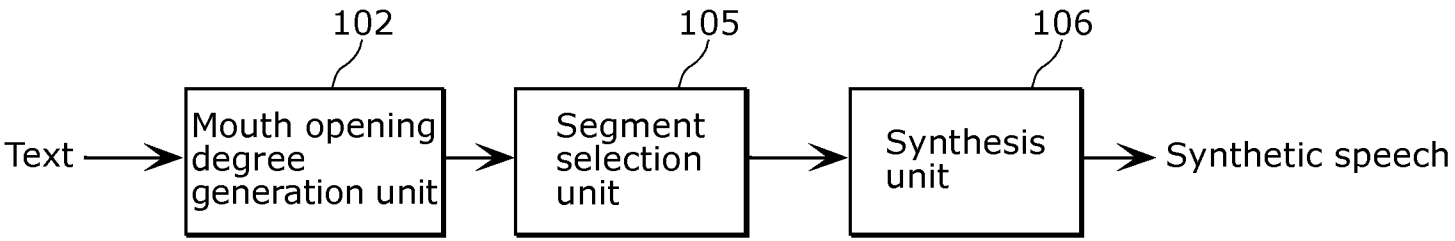
FIG. 16 is a configuration diagram of a speech synthesis device including structural elements essential to the present disclosure.
Figure 17:
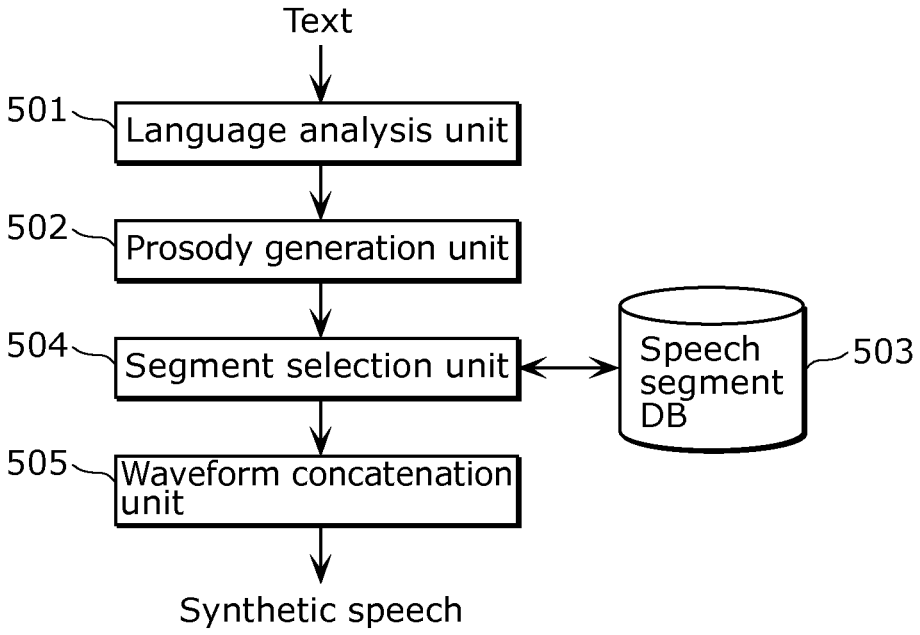
FIG. 17 PRIOR ART
FIG. 17 is a configuration diagram of a conventional speech synthesis device.

It should be noted that FIG. 16 is a block diagram showing a functional configuration of a speech synthesis device including structural elements essential to the present disclosure. This speech synthesis device is a device which generates synthetic speech of input text, and includes the mouth opening degree generation unit 102, the segment selection unit 105, and the synthesis unit 106.

The mouth opening degree generation unit 102 generates, for each of phonemes generated from the input text, a mouth opening degree corresponding to the volume of the oral cavity, by using information generated from the input text and indicating the type of the phoneme and the position of the target phoneme within the text, such that the mouth opening degree is larger for a phoneme positioned at the beginning of the sentence in the text is larger than for a phoneme positioned at the end of the sentence.

The segment selection unit 105 selects, for each of the phonemes generated from the text and based on the type of the target phoneme and the calculated mouth opening degree, a piece of segment information corresponding to the phoneme from among pieces of segment information each stored in a segment storage unit (not illustrated) and including the type of the phoneme, information regarding mouth opening degree, and speech segment data.

The synthesis unit 106 generates synthetic speech of the text by using the pieces of segment information selected by the segment selection unit 105 and prosody information generated from the text. It should be noted that the synthesis unit 106 may generate the prosody information or may obtain the prosody information from the outside (for example, the prosody generation unit 101 shown in Embodiment 1).

The embodiments and modifications thereof currently disclosed are, in all points, examples and are not restricting. The scope of the present disclosure is defined, not by the foregoing description, but by the Claims, and all modifications having equivalent meaning and falling within the scope of the Claims are intended to be included.

Industrial Applicability

The speech synthesis device according to one or more exemplary embodiments has a function of synthesizing speech while maintaining temporal variation in utterance manner during natural utterance estimated from input text.

The invention claimed is:

1. A speech synthesis device that generates synthetic speech of text that has been input, the speech synthesis device comprising:

a processor; and a non-transitory computer-readable medium having stored thereon executable instructions that, when executed by the processor, cause said speech synthesis device to function as:

a prosody generation unit configured to generate, for each of phonemes generated from the text, a piece of prosody information by using the text;

a mouth opening degree generation unit configured to generate, for each of the phonemes generated from the text, a mouth opening degree corresponding to an oral cavity volume, using information generated from the text and indicating a type of the phoneme and a position of the phoneme within the text, the mouth opening degree to be generated being larger for a phoneme positioned at a beginning of a sentence in the text than for a phoneme positioned at an end of the sentence;

a segment storage unit in which pieces of segment information are stored, each of the pieces of segment information including a phoneme type, information on a mouth opening degree, and speech segment data;

a segment selection unit configured to select, for each of the phonemes generated from the text, a piece of segment information corresponding to the phoneme from among the pieces of segment information stored in the segment storage unit, based on the type of the phoneme and the mouth opening degree generated by the mouth opening degree generation unit; and a synthesis unit configured to generate the synthetic speech of the text, using the pieces of segment information selected by the segment selection unit and the pieces of prosody information generated by the prosody generation unit.

2. The speech synthesis device according to claim 1, wherein the executable instructions, when executed by said processor, cause said speech synthesis device to further function as an agreement degree calculation unit configured to, for each of the phonemes generated from the text, select a piece of segment information having a phoneme type that matches the type of the phoneme from among the pieces of segment information stored in the segment storage unit, and calculate a degree of agreement between the mouth opening degree generated by the mouth opening degree generation unit and the mouth opening degree included in the selected piece of segment information, wherein the segment selection unit is configured to select, for each of the phonemes generated from the text, the piece of segment information corresponding to the phoneme, based on the degree of agreement calculated for the phoneme.

3. The speech synthesis device according to claim 2, wherein the segment selection unit is configured to select, for each of the phonemes generated from the text, the piece of segment information including the mouth opening degree indicated by the degree of agreement calculated for the phoneme as having highest agreement.

4. The speech synthesis device according to claim 2, wherein each of the pieces of segment information stored in the segment storage unit further includes prosody information and phoneme environment information indicating a type of a preceding phoneme or a following phoneme that precedes or follows the phoneme, and the segment selection unit is configured to select, for each of the phonemes generated from the text, the piece of segment information corresponding to the phoneme from among the pieces of segment information stored in the segment storage unit, based on the type, the mouth opening degree, and phoneme environment information of the phoneme, and the piece of prosody information generated by the prosody generation unit.

5. The speech synthesis device according to claim 4, wherein the executable instructions, when executed by said processor, cause said speech synthesis device to further function as a target cost calculation unit configured to, for each of the phonemes generated from the text, select the piece of segment information having the phoneme type that matches the type of the phoneme from among the pieces of segment information stored in the segment storage unit, and calculate a cost indicating agreement between the phoneme environment information of the phoneme and the phoneme environment information included in the selected piece of segment information, wherein the segment selection unit is configured to select, for each of the phonemes generated from the text, the piece of segment information corresponding to the phoneme, based on the degree of agreement and the cost that were calculated for the phoneme.

6. The speech synthesis device according to claim 5, wherein the segment selection unit is configured to, for each of the phonemes generated from the text, assign a weight to the cost calculated for the phoneme, and select the piece of segment information corresponding to the phoneme, based on the weighted cost and the degree of agreement calculated by the agreement degree calculation unit, the assigned weight being larger as the pieces of segment information stored in the segment storage unit are larger in number.

7. The speech synthesis device according to claim 2, wherein the agreement degree calculation unit is configured to, for each of the phonemes generated from the text, normalize, on a phoneme type basis, (i) the mouth opening degree included in the piece of segment information stored in the segment storage unit and having the phoneme type that matches the type of the phoneme and (ii) the mouth opening degree generated by the mouth opening degree generation unit, and calculate, as the degree of agreement, a degree of agreement between the normalized mouth opening degrees.

8. The speech synthesis device according to claim 2, wherein the agreement degree calculation unit is configured to, for each of the phonemes generated from the text, calculate, as the degree of agreement, a degree of agreement between a time direction difference of the mouth opening degree generated by the mouth opening degree generation unit and a time direction difference of the mouth opening degree included in the piece of segment information stored in the segment storage unit and having the phoneme type that matches the type of the phoneme.

9. The speech synthesis device according to claim 1, wherein the executable instructions, when executed by said processor, cause said speech synthesis device to further function as:

a mouth opening degree calculation unit configured to calculate, from a speech of a speaker, a mouth opening degree corresponding to an oral cavity volume of the speaker; and a segment registration unit configured to register, in the segment storage unit, segment information including the phoneme type, information on the mouth opening degree calculated by the mouth opening degree calculation unit, and the speech segment data.

10. The speech synthesis device according to claim 9, wherein the executable instructions, when executed by said processor, cause said speech synthesis device to further function as a vocal tract information extraction unit configured to extract vocal tract information from the speech of the speaker, wherein the mouth opening degree calculation unit is configured to calculate a vocal tract cross-sectional area function indicating vocal tract cross-sectional areas, from the vocal tract information extracted by the vocal tract information extraction unit, and calculate, as the mouth opening degree, a sum of the vocal tract cross-sectional areas indicated by the calculated vocal tract cross-sectional area function.

11. The speech synthesis device according to claim 10, wherein the mouth opening degree calculation unit is configured to calculate the vocal tract cross-sectional area function indicating the vocal tract cross-sectional areas on a per section basis, and calculate, as the mouth opening degree, a sum of the vocal tract cross-sectional areas indicated by the calculated vocal tract cross-sectional area function, from a section corresponding to lips up to a predetermined section.

12. The speech synthesis device according to claim 1, wherein the mouth opening degree generation unit is configured to generate the mouth opening degree, using information generated from the text and indicating the type of the phoneme and a position of the phoneme within an accent phrase.

13. The speech synthesis device according to claim 12, wherein the position of the phoneme within the accent phrase denotes a distance from an accent position within the accent phrase.

14. The speech synthesis device according to claim 12, wherein the mouth opening generation unit is further configured to generate the mouth opening degree using information generated from the text and indicating a part of speech of a morpheme to which the phoneme belongs.

15. A speech synthesis device that generates synthetic speech of text that has been input, the speech synthesis device comprising:

a processor; and a non-transitory computer-readable medium having stored thereon executable instructions that, when executed by the processor, cause said speech synthesis device to function as:

a mouth opening degree generation unit configured to generate, for each of phonemes generated from the text, a mouth opening degree corresponding to an oral cavity volume, using information generated from the text and indicating a type of the phoneme and a position of the phoneme within the text, the mouth opening degree to be generated being larger for a phoneme positioned at a beginning of a sentence in the text than for a phoneme positioned at an end of the sentence;

a segment selection unit configured to select, for each of the phonemes generated from the text, a piece of segment information corresponding to the phoneme from among pieces of segment information stored in a segment storage unit, based on the type of the phoneme and the mouth opening degree generated by the mouth opening degree generation unit, each of the pieces of segment information including a phoneme type, information on a mouth opening degree, and speech segment data; and a synthesis unit configured to generate the synthetic speech of the text, using the pieces of segment information selected by the segment selection unit and pieces of prosody information generated from the text.

16. A speech synthesis method for generating synthetic speech of text that has been input, the speech synthesis method comprising:

generating, for each of phonemes generated from the text, a piece of prosody information by using the text;

generating, for each of the phonemes generated from the text, a mouth opening degree corresponding to an oral cavity volume, using information generated from the text and indicating a type of the phoneme and a position of the phoneme within the text, the mouth opening degree to be generated being larger for a phoneme positioned at a beginning of a sentence in the text than for a phoneme positioned at an end of the sentence;

selecting, for each of the phonemes generated from the text, a piece of segment information corresponding to the phoneme from among pieces of segment information stored in a segment storage unit, based on the type of the phoneme and the generated mouth opening degree, each of the pieces of segment information including a phoneme type, information on a mouth opening degree, and speech segment data; and generating the synthetic speech of the text, using the selected piece of segment information and the generated prosody information.

17. A non-transitory computer-readable recording medium having a computer program recorded thereon for causing a computer to execute the speech synthesis method according to claim 16.

* * * * *